US012018532B2

(12) United States Patent
Graham et al.

(10) Patent No.: US 12,018,532 B2
(45) Date of Patent: Jun. 25, 2024

(54) HOLE OPENER

(71) Applicant: Precise Drilling Components Ltd, Calgary (CA)

(72) Inventors: Cody D. Graham, Calgary (CA); James Wheeler, Calgary (CA); Juan Ottati, Calgary (CA)

(73) Assignee: Precise Drilling Components Ltd, Calgary (CA)

( * ) Notice: Subject to any disclaimer, the term of this patent is extended or adjusted under 35 U.S.C. 154(b) by 0 days.

(21) Appl. No.: 18/063,801

(22) Filed: Dec. 9, 2022

(65) Prior Publication Data

US 2023/0184040 A1 Jun. 15, 2023

Related U.S. Application Data

(60) Provisional application No. 63/287,729, filed on Dec. 9, 2021.

(51) Int. Cl.
*E21B 7/24* (2006.01)
*E21B 4/00* (2006.01)
(Continued)

(52) U.S. Cl.
CPC ..... *E21B 10/44* (2013.01); *E21B 4/006* (2013.01); *E21B 4/14* (2013.01); *E21B 7/24* (2013.01); *E21B 7/28* (2013.01); *E21B 10/445* (2013.01)

(58) Field of Classification Search
CPC ... E21B 4/006; E21B 4/14; E21B 7/24; E21B 7/28; E21B 10/40; E21B 10/44;
(Continued)

(56) References Cited

U.S. PATENT DOCUMENTS 129,283 A * 7/1872 Jilz ..... E21B 10/44 175/242
3,107,742 A * 10/1963 Woods ..... E21B 49/02 175/309
(Continued)

FOREIGN PATENT DOCUMENTS

CN 203050486 U 7/2013
CN 104863496 A 8/2015
(Continued)

OTHER PUBLICATIONS

CRI, LP Drill for Drilling Excavation, Jun. 11, 2021.
KSBIT, Hammer Bit Hole Openers, Jun. 11, 2021.

*Primary Examiner* — Tara Schimpf
*Assistant Examiner* — Jennifer A Railey
(74) *Attorney, Agent, or Firm* — Michael Best & Friedrich LLP

(57) ABSTRACT

A hole opener configured for use with a power unit to open a hole. The hole opener comprises a gearbox including a hydraulic inlet fluidly coupled to the power unit and an exciter fluidly coupled to the hydraulic inlet, the exciter being coupled to a gear train including an imbalanced mass which is configured to generate vibrations upon receipt of pressurized hydraulic fluid from the hydraulic inlet. The hole opener further comprises a connector coupled to the gearbox for receiving the vibrations, the connector defining a void, and a hammer slidably coupled to the connector within the void, the hammer configured to receive the vibrations from the connector and to transmit the vibrations to the hole.

27 Claims, 19 Drawing Sheets

(51) Int. Cl.
*E21B 4/14* (2006.01)
*E21B 7/28* (2006.01)
*E21B 10/44* (2006.01)

(58) Field of Classification Search
CPC ..... E21B 10/445; E21B 10/02; E21B 25/04; E21B 25/10; E21B 27/04; E21B 49/02
See application file for complete search history.

(56) References Cited

U.S. PATENT DOCUMENTS

| | | | | |
|---|---|---|---|---|
| 4,061,197 | A | 12/1977 | Skidmore, Jr. | |
| 6,129,159 | A * | 10/2000 | Scott | E21B 7/24 173/49 |
| 6,892,834 | B1 * | 5/2005 | Beck, III | E21B 7/006 175/385 |
| 2008/0000692 | A1 * | 1/2008 | Roussy | E21B 7/24 175/56 |
| 2009/0159335 | A1 * | 6/2009 | Cravatte | E21B 25/00 175/403 |
| 2020/0087994 | A1 | 3/2020 | Hogan et al. | |

FOREIGN PATENT DOCUMENTS

| | | | | |
|---|---|---|---|---|
| CN | 105971495 | A | 9/2016 | |
| CN | 104747085 | B | 3/2017 | |
| WO | 2020/183441 | A1 | 9/2020 | |
| WO | WO-2020243767 | A1 * | 12/2020 | E21B 10/02 |

* cited by examiner

HOLE OPENER

CROSS-REFERENCE TO RELATED APPLICATIONS

This application claims priority to U.S. Provisional Patent Application No. 63/287,729, filed on Dec. 9, 2021, the entire content of which is incorporated herein by reference

TECHNICAL FIELD

The present invention relates to a hole opener, and more particularly to a hole opener suited for use with a hydraulic power unit.

SUMMARY

In one embodiment, the invention provides a hole opener configured for use with a power unit to open a hole. The hole opener comprises a gearbox including a hydraulic inlet fluidly coupled to the power unit and an exciter fluidly coupled to the hydraulic inlet, the exciter being coupled to a gear train including an imbalanced mass which is configured to generate vibrations upon receipt of pressurized hydraulic fluid from the hydraulic inlet. The hole opener further comprises a connector coupled to the gearbox for receiving the vibrations, the connector defining a void, and a hammer slidably coupled to the connector within the void, the hammer configured to receive the vibrations from the connector and to transmit the vibrations to the hole.

In one independent embodiment, the invention provides a hole opener configured for use with a power unit and a Kelly bar to open a hole. The hole opener comprises a gearbox including a hydraulic inlet fluidly coupled to the power unit and an exciter fluidly coupled to the hydraulic inlet, the exciter being coupled to a gear train including an imbalanced mass which is configured to generate vibrations upon receipt of pressurized hydraulic fluid from the hydraulic inlet. The hole opener further comprises a connector coupled to the gearbox for receiving the vibrations, the connector defining a void, a hammer slidably coupled to the connector within the void, the hammer configured to receive the vibrations from the connector and to transmit the vibrations to the hole, a barrel at least partially surrounding the gearbox, the barrel including a Kelly-Jeffrey box configured to receive external force from the Kelly bar, and a swivel coupled to the Kelly Jeffrey box and operable to rotate about the Kelly-Jeffrey box, the swivel further including a coupling in fluid communication with the hydraulic inlet and the power unit such that the hydraulic fluid passes through the coupling to power the exciter.

In one embodiment, the invention provides a hole opener configured for use with a power unit to open a hole. The hole opener comprises a gearbox including a hydraulic inlet fluidly coupled to the power unit and an exciter fluidly coupled to the hydraulic inlet, the exciter being coupled to a gear train including an imbalanced mass which is configured to generate vibrations upon receipt of pressurized hydraulic fluid from the hydraulic inlet. The hole opener further comprises a connector coupled to the gearbox for receiving the vibrations, the connector defining a void, a hammer slidably coupled to the connector within the void, the hammer configured to receive the vibrations from the connector and to transmit the vibrations to the hole to generate cuttings, and auger configured to collect the cuttings, the auger defining a generally helical void revolved along and about an axis between helical ends a revolve angle extending greater than 360 degrees.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
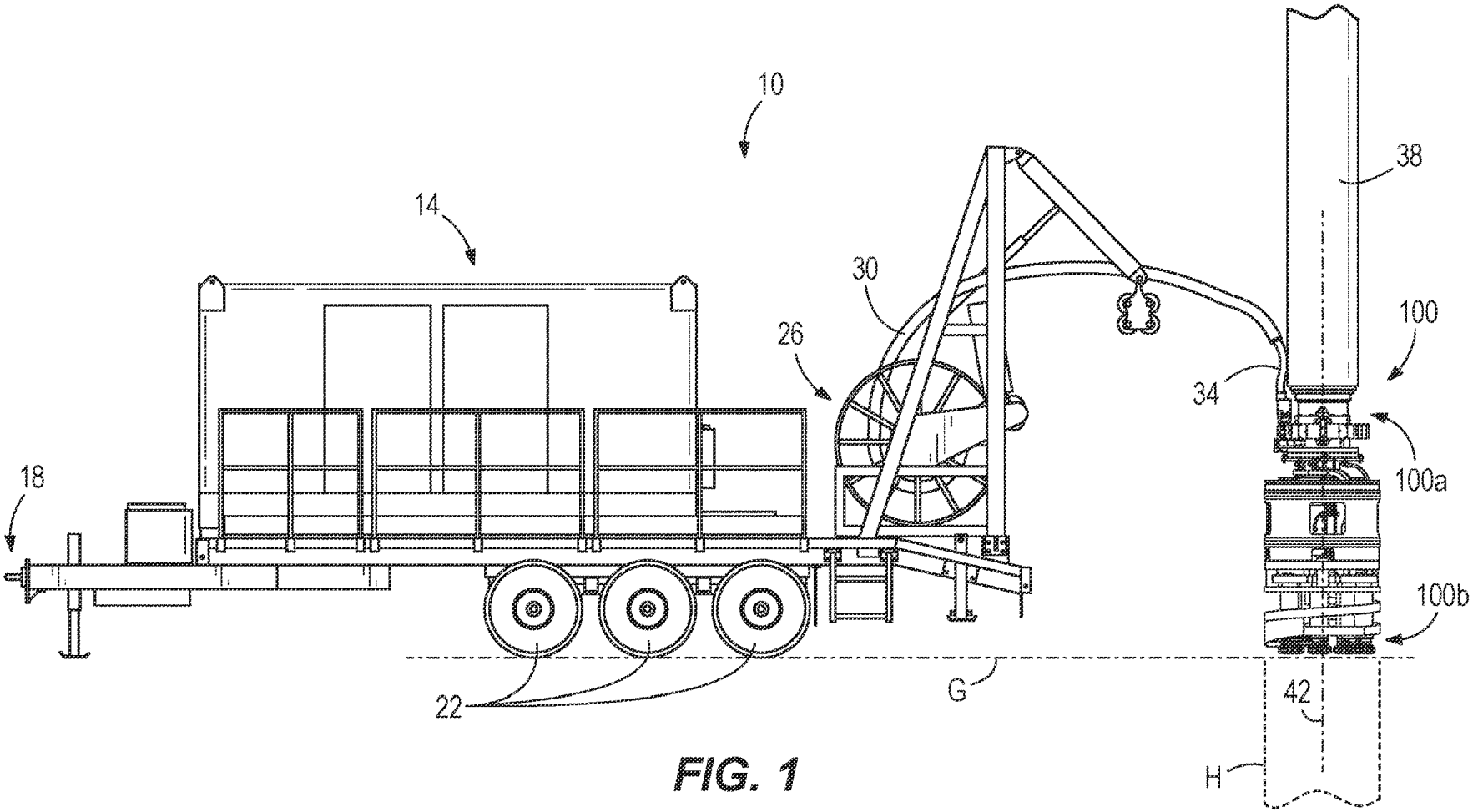
FIG. 1 is a side view of a drilling rig including a hole opener according to one embodiment of the invention.

FIG. 1 illustrates a drilling rig 10 including a hole opener 100. The drilling rig 10 receives power from a power unit 14. As will be explained in detail below, the power unit 14 is configured to pass pressurized hydraulic fluid to the hole opener 100, and the hole opener 100 is configured to generate vibrations to open a hole H. In the illustrated embodiment, the power unit 14 is a trailer mounted power unit 14 including a trailer hitch 18 and a plurality of wheels 22. The trailer hitch 18 is operable to be coupled to a vehicle (not shown), while the wheels 22 support the power unit 14 on the ground G during transport of the drilling rig 10. The drilling rig 10 further comprises a hose reel 26 configured to feed a hose bundle 30 to the hole opener 100 as the hole opener 100 is moved relative to the drilling rig 10. The hose bundle 30 may include multiple hoses 34 for passing hydraulic fluid between the power unit 14 and the hole opener 100. The hole opener 100 includes a first end 100*a* and an opposite second end 100*b*. The drilling rig 10 further includes a Kelly bar 38 coupled to the hole opener 100 adjacent the first end 100*a* thereof. The Kelly bar 38 may push repeatedly on the hole opener 100 along a longitudinal axis 42. The Kelly bar 38 may also rotate the hole opener 100. As illustrated in FIG. 1, the longitudinal axis 42 passes through the Kelly bar 38 as well as the first and second ends 100*a*, 100*b*. The Kelly bar 38 may be powered by an external power unit (not shown). The size of the hole opener 100 (e.g., the diameter thereof) may correspond with a desired hole size to be generated by the drilling rig 10. While the hole opener 100 may be sized in accordance with any desired hole size, in some embodiments, the hole opener 100 may have a diameter of approximately 36 inches (approximately 0.9 meters). In other embodiments, the hole opener 100 may have a diameter of approximately 54 inches (approximately 1.4 meters).

In a cutting operation of the drilling rig 10 and hole opener 100, pressurized hydraulic fluid from the power unit 14 passes through the hoses 34 to power vibration of the hole opener 100. Simultaneously, the Kelly bar 38 provides either a downward pushing (i.e., constant) force or a downward impact (i.e., intermittent) force upon the first end 100*a* and along the longitudinal axis 42 towards the second end 100*b*. The Kelly bar 38 may also simultaneously rotate the hole opener 100. The hole opener 100 thus opens a hole H in the ground G, and the hole opener 100 opens the hole H. As the hole opener 100 opens the hole H, the hose reel 26 feeds the hose bundle 30 so the hoses 34 remain in fluid communication with the hole opener 100. The hole opener 100 is configured to gather cuttings generated by the hole opener 100. As cuttings generated by the hole opener 100 fill the hole opener 100, the hole opener 100 is retracted from the hole H to a position above the ground G (i.e., as shown in FIG. 1) to clear cuttings from the hole opener 100. An upward (constant or impact) force on the Kelly bar 38 retracts the hole opener 100 from the hole H to the position above the ground G. As the hole opener 100 is retracted from the hole H, the hose bundle 30 is retracted into the hose reel 26.

Figure 2:
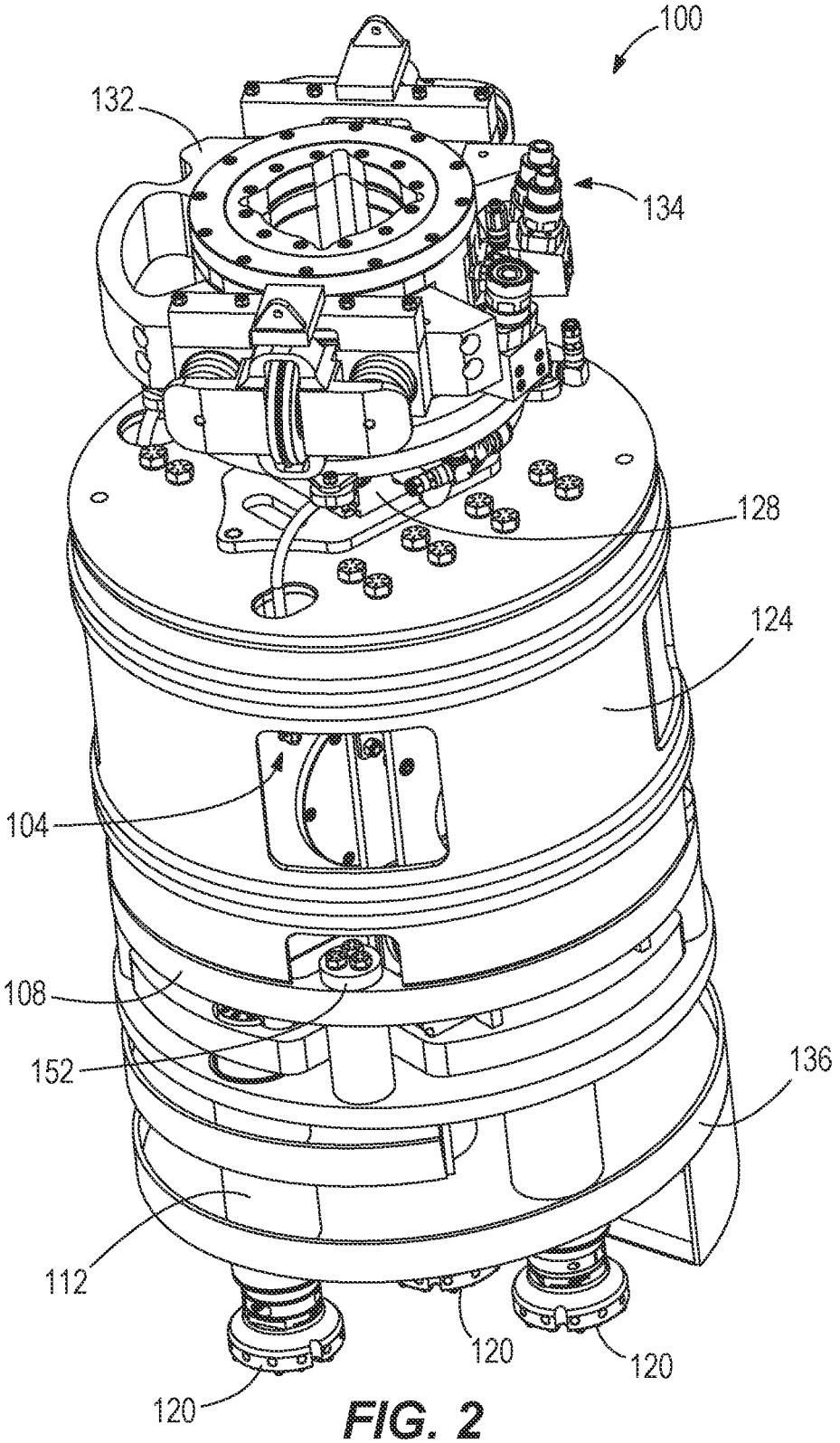
FIG. 2 is a perspective view of the hole opener of FIG. 1
Figure 4:
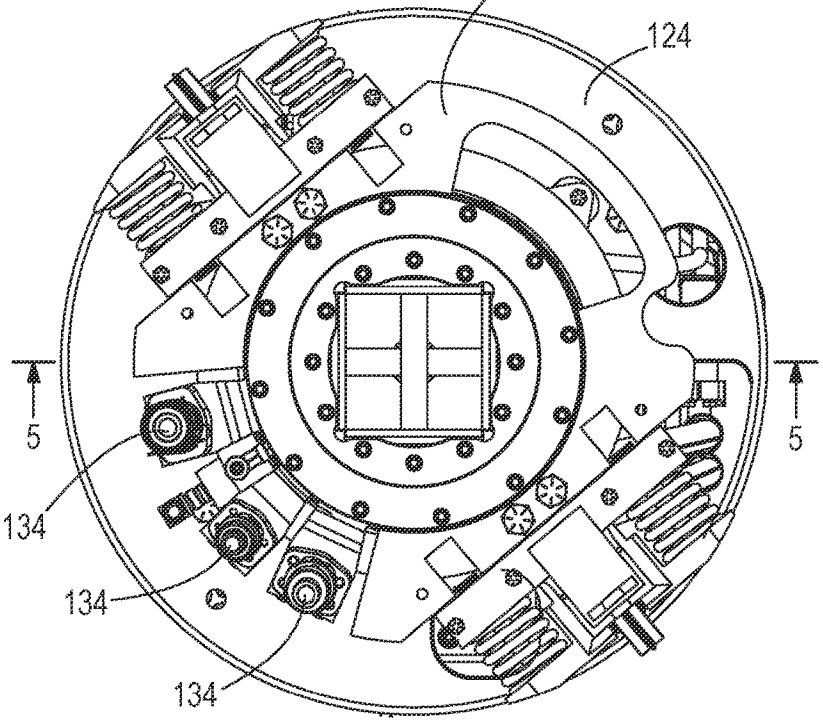
FIG. 4 is a top view of the hole opener of FIG. 1.
Figure 3:
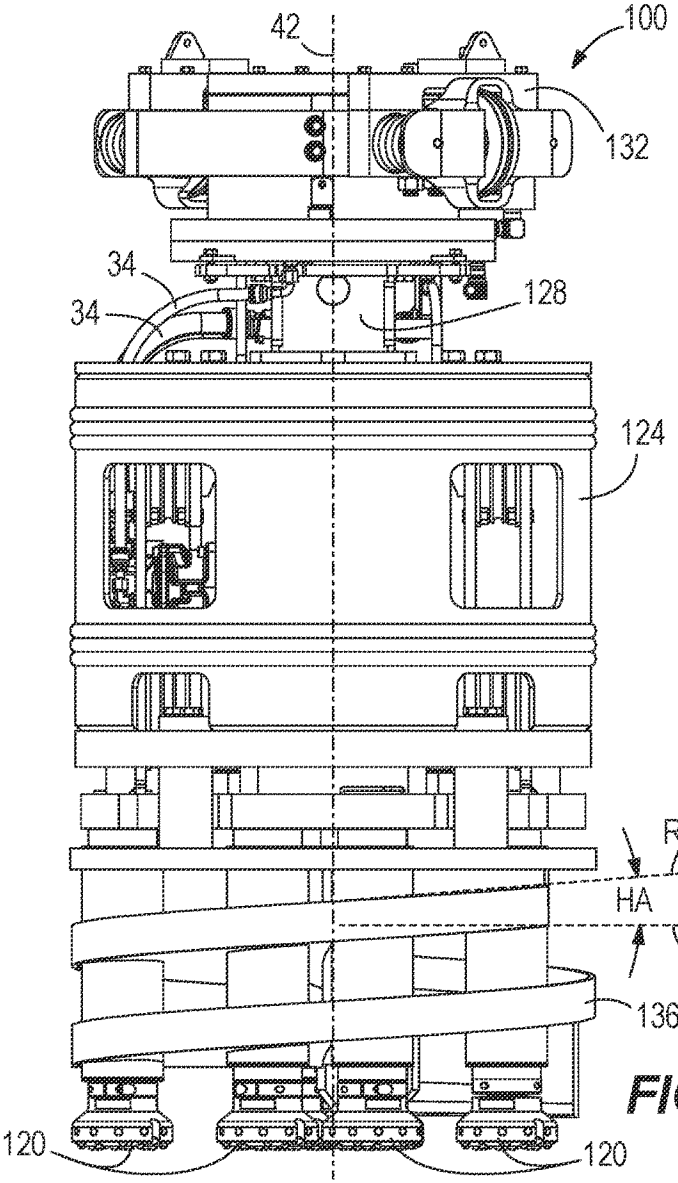
FIG. 3 is a side view of the hole opener of FIG. 1
Figure 5:
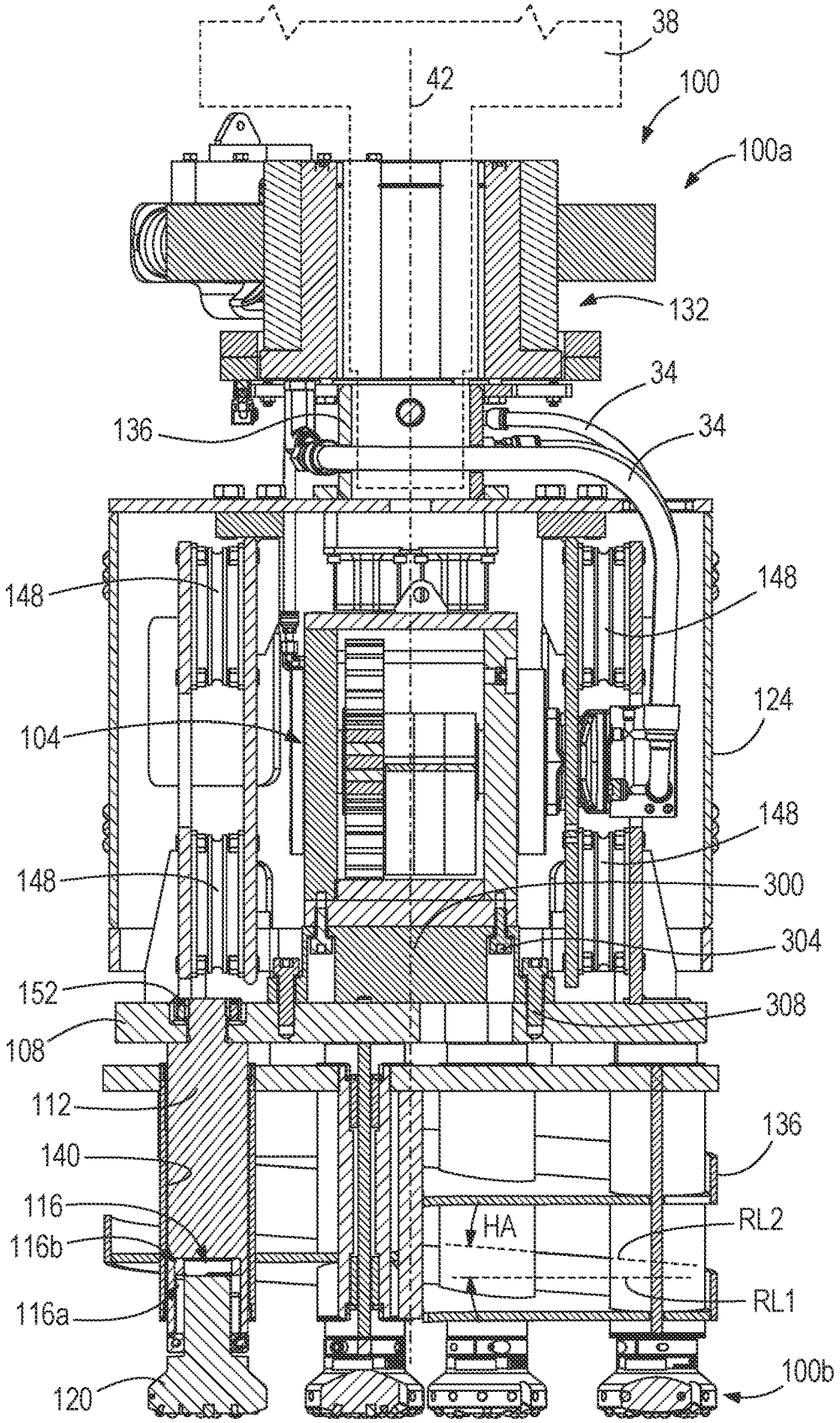
FIG. 5 is a cross-sectional view of the hole opener of FIG. 1 taken along section line 5-5 in FIG. 4.
Figure 6:
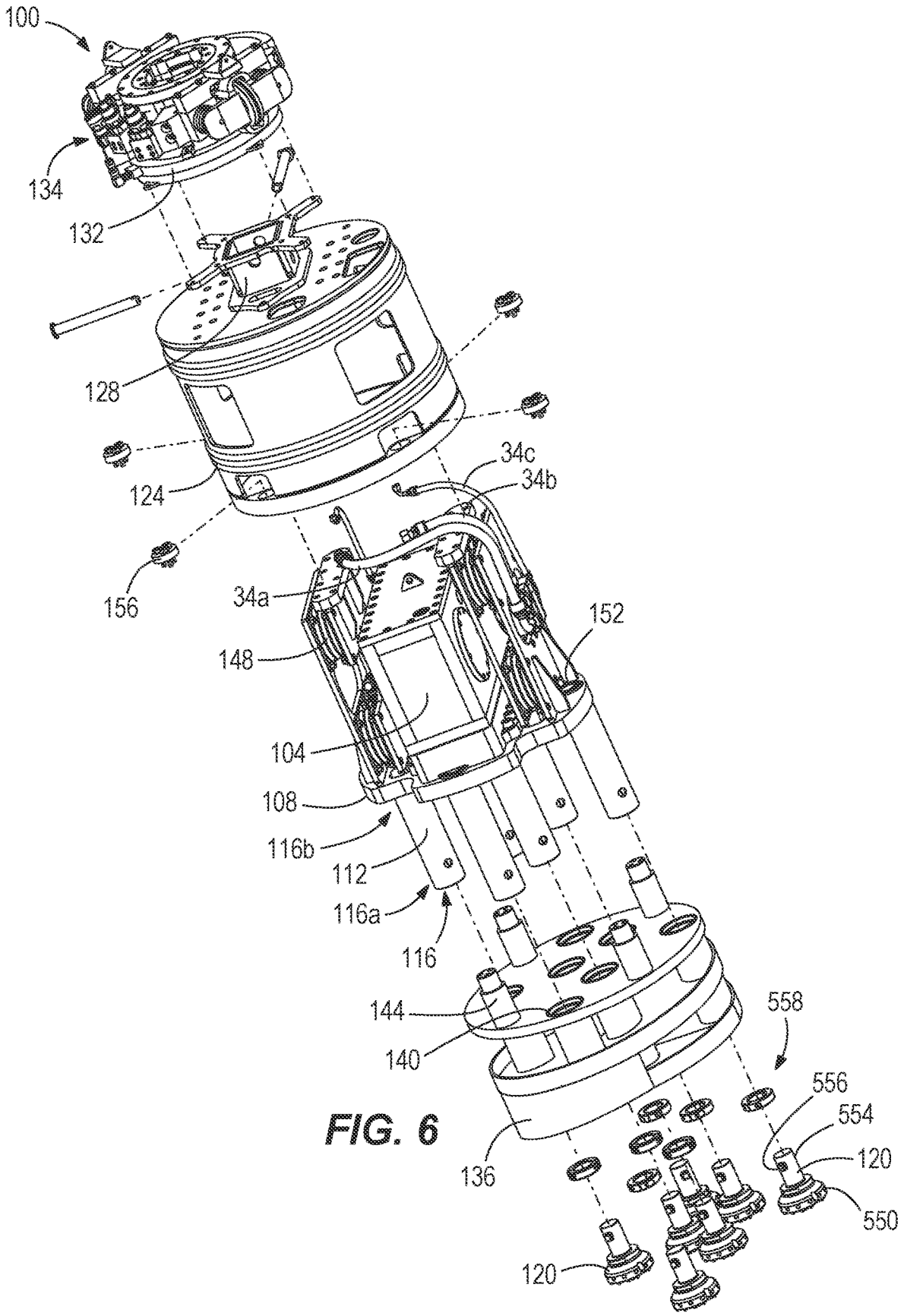
FIG. 6 is an exploded view of the hole opener of FIG. 1.
Figure 7:
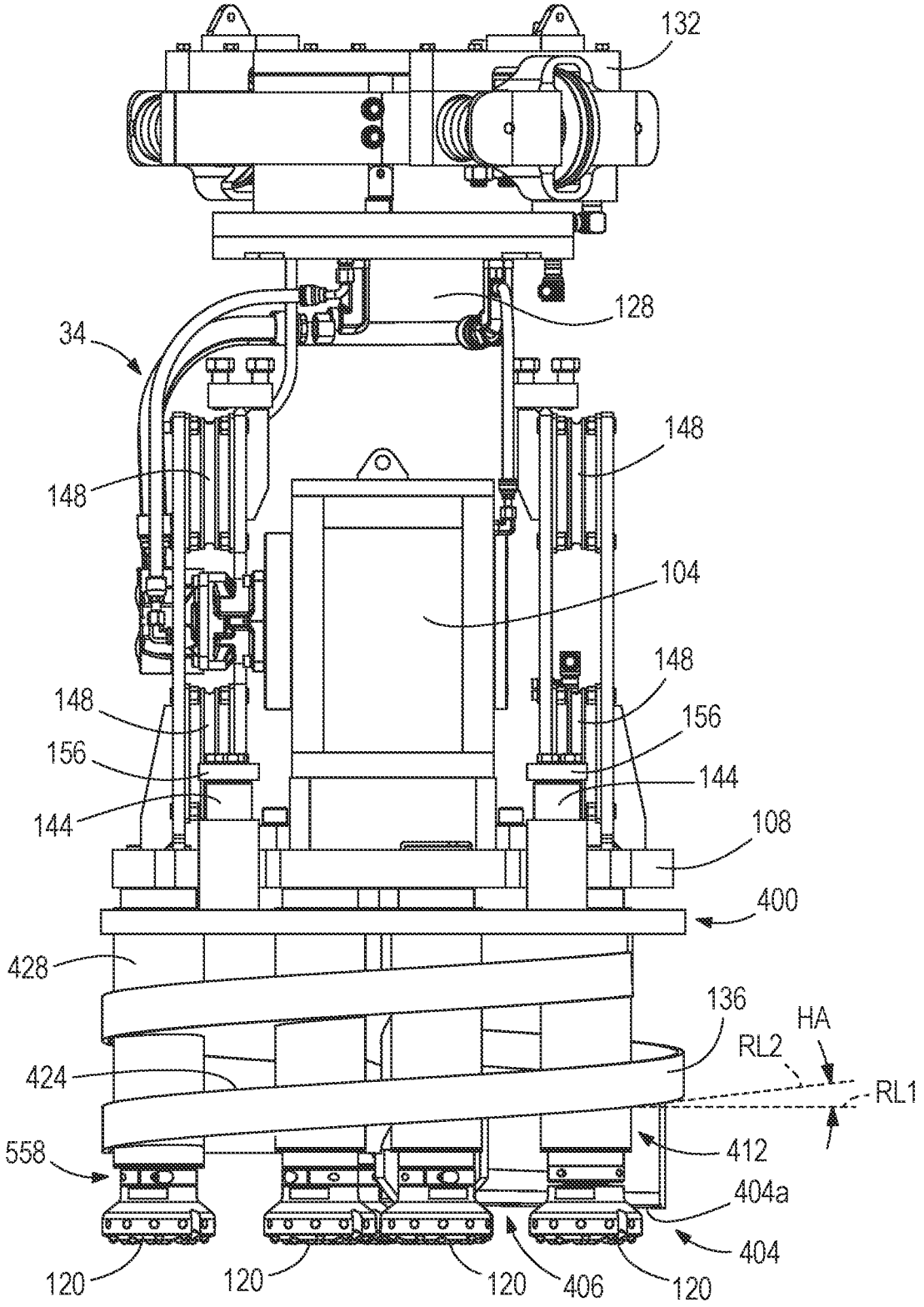
FIG. 7 is a side view of the hole opener of FIG. 1 with a barrel of the hole opener removed.

FIGS. 2-4 illustrate external views of the hole opener 100. As best seen in FIG. 5, the hole opener 100 includes a gearbox 104 mounted on a mount plate 108. The mount plate 108 is generally planar in a direction perpendicular to the axis 42. A connector 112 is coupled to the mounting plate 108. In the illustrated embodiment, the connector 112 may be in the form of an annular rod. In other embodiments, the connector 112 may be otherwise shaped. The connector 112 includes a void 116 within which a hammer 120 is positioned. The hole opener 100 further includes a barrel 124. The barrel 124 is generally cylindrical. The barrel 124 surrounds the gearbox 104 between the first end 100*a* and the second end 100*b* of the hole opener 100. Adjacent the first end 100*a*, the barrel 124 is provided with a Kelly-Jeffrey box 128. The Kelly-Jeffrey box 128 is coupled to both the Kelly bar 38 and a swivel 132. The Kelly bar 38 can impart external forces upon the hole opener 100 to be received by the Kelly-Jeffrey box 128. The swivel 132 includes couplings 134 which are mechanically coupled to the hoses 34 to permit fluid communication between the hoses 34 and the hydraulic fluid inlet 200 of the gearbox 104. The swivel 132 permits the hole opener 100 to rotate about the axis 42. The swivel 132 and correspond couplings 134 permit rotation of the hole opener 100 relative to the power unit 14 while maintaining fluid communication between the hoses 34 and the couplings 134 while inhibiting tangling of the hoses 34. Adjacent the second end 100*b*, the hole opener 100 includes an auger 136 configured to gather cuttings generated by the hammers 120. FIGS. 6 and 7 offer alternate views of the components described above with respect to FIG. 5.

Figure 13:
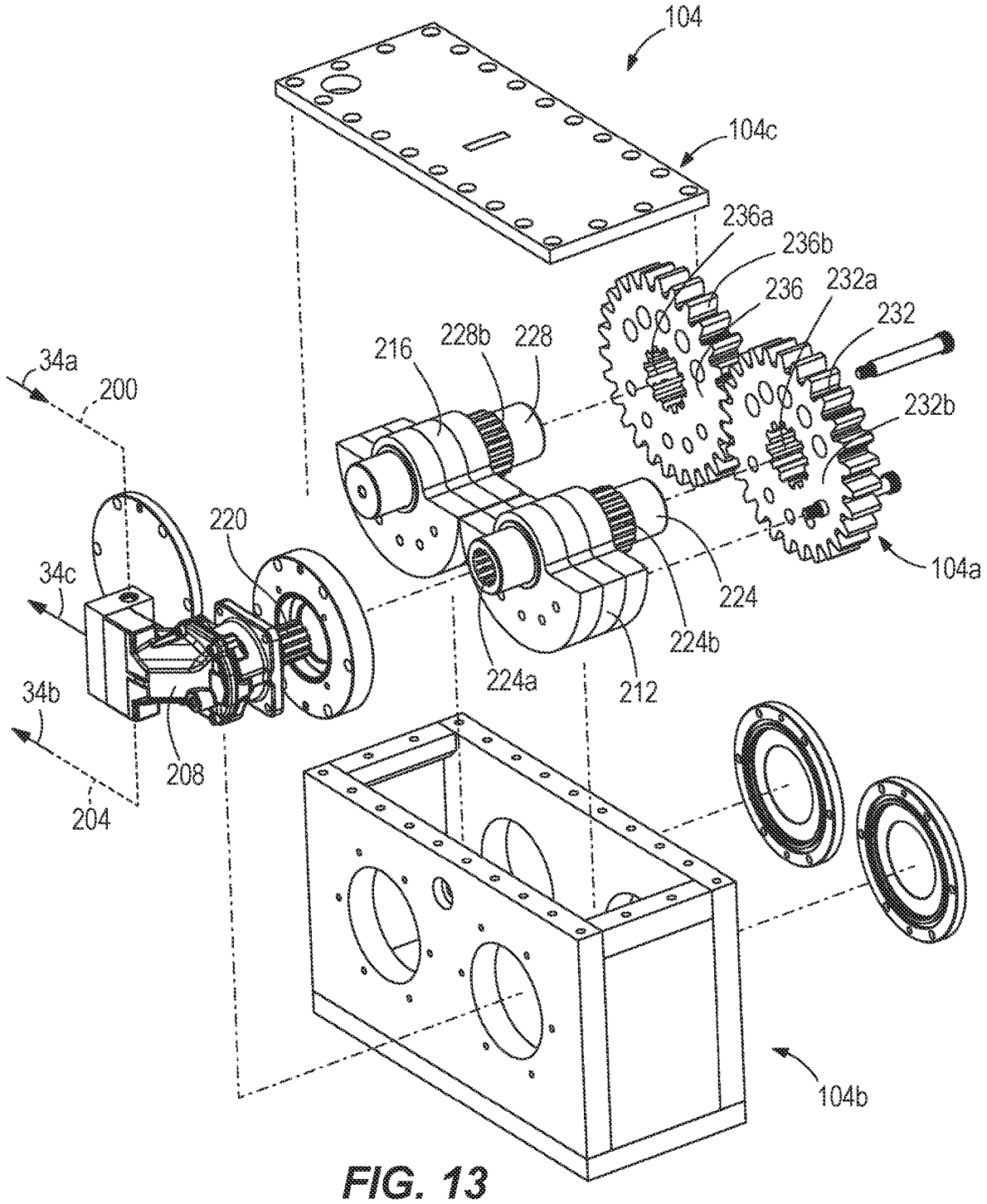
FIG. 13 is an exploded view of a gearbox of the hole opener of FIG. 1.

FIG. 13 illustrates the gearbox 104 in detail. The gearbox 104 includes a hydraulic fluid inlet 200, a hydraulic fluid outlet 204, and an exciter 208. Both the hydraulic fluid inlet 200 and the hydraulic fluid outlet 204 are in fluid communication with the hoses 34 and the exciter 208. The hydraulic fluid inlet 200 is coupled with a high-pressure hose 34*a*, and the hydraulic fluid outlet 204 is coupled with a low-pressure hose 34*b*. A motor return hose 34*c* is also coupled with the exciter 208. The motor return hose 34*c* is in fluid communication with the power unit 14 to return hydraulic fluid to the power unit 14. These hoses 34*a*-34*c* are further illustrated in at least FIG. 6. Pressurized hydraulic fluid passes from the power unit 14, through the hose 34 and the couplings 134 to the hydraulic fluid inlet 200. The exciter 208 is rotated by the pressurized fluid from the hydraulic fluid inlet 200, and the pressurized fluid is partially de-pressurized. The partially de-pressurized hydraulic fluid returns through the hydraulic fluid outlet 204, the couplings 134, and the hose 34 to the power unit 14 for re-pressurization.

With continued reference to FIG. 13, the gearbox 104 includes a gear train 104*a* which transmits rotation generated by the exciter 208 to imbalanced masses 212, 216. The imbalanced masses 212, 216 are rotated such that the gearbox 104 generates the vibration of the hole opener 100. Each of the imbalanced masses 212, 216 contribute to the generation of vibrations upon receipt of pressurized fluid by the exciter 208 at the hydraulic fluid inlet 200. The exciter 208 includes an output shaft 220 which is rotated upon receipt of pressurized hydraulic fluid at the hydraulic fluid inlet 200. The output shaft 220 of the exciter 208 is rotated by a difference in pressure between the pressurized fluid and the partially de-pressurized fluid on opposite ends of the exciter 208. The illustrated gear train 104*a* further includes a first shaft 224 and a second shaft 228 as well as a first gear 232 and a second gear 236. Other gear trains 104*a* may be possible. The first shaft 224 includes internal teeth 224*a* and external teeth 224*b*. The first gear 232 includes internal teeth 232*a* and external teeth 232*b*. The second gear 236 includes internal teeth 236*a* and external teeth 236*b*. Finally, the second shaft 228 includes external teeth 228*b*. The imbalanced mass 212 is secured to the first shaft 224, and the imbalanced mass 216 is secured to the second shaft 228.

In the assembled gearbox 104, the output shaft 220 of the exciter 208 engages the internal teeth 224*a* of the first shaft 224. The external teeth 224*b* mesh with the internal teeth 232*a* of the first gear 232. The external teeth 232*b* of the first gear 232 mesh with the external teeth 236*b* of the second gear 236. Internal teeth 236*a* of the second gear 236 mesh with the external teeth 228*b* of the second shaft 228. As such, receipt of pressurized hydraulic fluid by the exciter 208 causes rotation of the output shaft 220, the first shaft 224, and the second shaft 228. The first shaft 224 and thus the imbalanced mass 212 rotate in a first direction (e.g., clockwise). The second shaft 228 and thus the imbalanced mass 216 rotate in a second direction substantially opposite to the first direction (e.g., counter-clockwise). As such, the imbalanced mass 212 and the imbalanced mass 216 are counter rotating masses. Rotation of the imbalanced masses 212, 216 thus generates vibration of the hole opener 100. The geometry and coupling of the components of the illustrated gear train 104*a* promote generation of vibrations to be generally parallel with the axis 42. The gearbox 104 further includes a box 104*b* which contains the gear train 104*a* and a cover 104*c* which may be removable from the box 104*b*.

As illustrated in FIG. 5, the box 104*b* is secured to a mount 300 by a fastener 304. The mount 300 is secured to the mount plate 108 by a fastener 308. As such, vibrations generated by the gearbox 104 are transmitted to the mount plate 108 through the mount 300 and the fasteners 304, 308.

Figure 8:
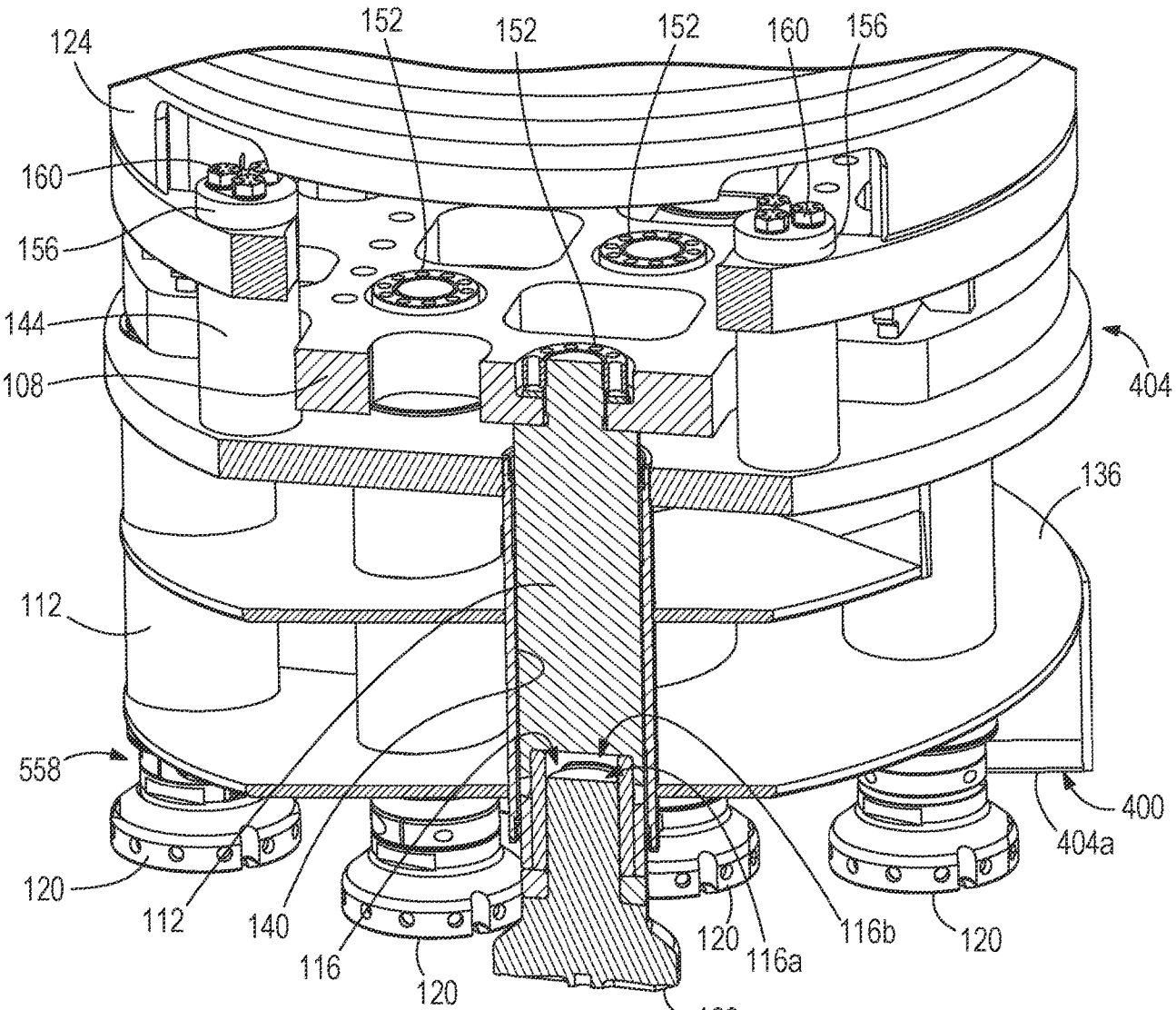
FIG. 8 is a cross-sectional view taken through a hammer connector of the hole opener of FIG. 1.

With reference to FIGS. 5 and 8, the auger 136 includes sleeves 140 which receive the connectors 112. The sleeves 140 are generally annular and extend in a direction parallel with the axis 42. The connectors 112 are coupled to the mount plate 108 and the hammers 120 for transmitting vibrations generated by the gearbox 104 and passed to the mount plate 108 to the hammers 120. A mechanical tensioner 152 is secured to the connector 112 on an opposite side of the mount plate 108 as the hammer 120. Accordingly, the tensioner 152 can provide connection between the connector 112 and the mount plate 108. Vibrations can pass through the mount plate 108, the tensioner 152, and the connector 112 to the hammers 120. The hammers 120 are capable of translation (as described in detail with respect to FIG. 12 below) within the void 116 between a first end 116*a* of the void 116 and a second end 116*b* of the void 116. The tensioner 152 may be, for example, a Supernuts® mechanical tensioner manufactured by Nord-Lock International AB of Malmo Sweden. However, other suitable tensioners 152 may be used. The tensioner 152 is configured to apply high amounts of pre-tension to the connector 112 under heavy vibration loads.

Figure 9:
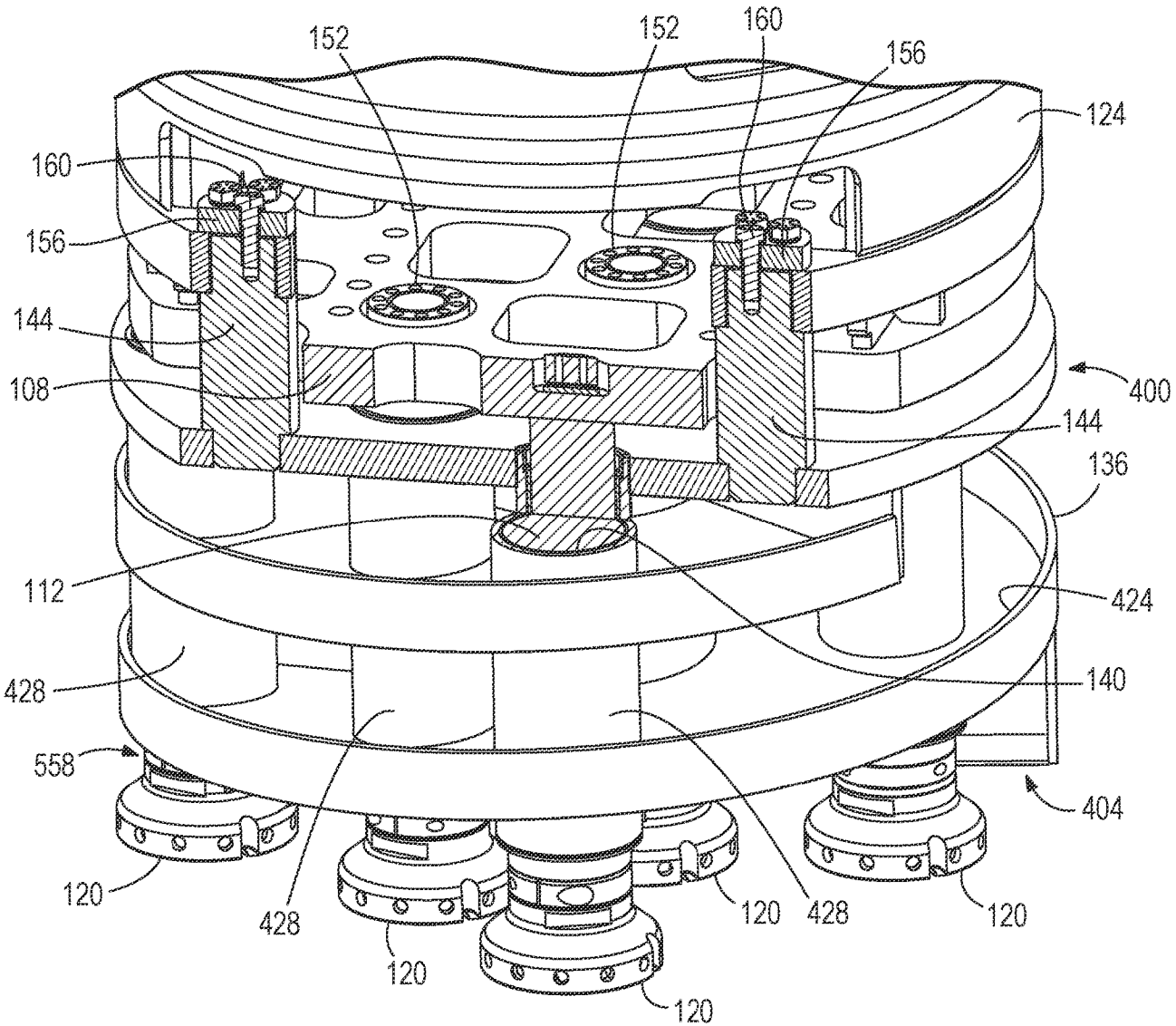
FIG. 9 is a cross-sectional view taken through a torsion connection rod of the hole opener of FIG. 1.

With reference to FIGS. 5 and 9, a torsion connector 144 engages both the auger 136 and the barrel 124 such that the auger 136 rotates upon rotation of the barrel 124. A cylindrical plate 156 is located against the barrel 124 and the connector 144. A fasteners 160 secures the cylindrical plate 156 to the connector 144 with the cylindrical plate 156 pressing against the barrel 124. While the illustrated embodiment is secured by fasteners 160, any means of securing the connector 144 with the barrel 124 may be possible. The torsion connector 144 transmits torque between the barrel 124 and the auger 136. The torque originated by the Kelly bar 38 is passed through the Kelly-Jeffrey box 128 and thus the barrel 124 and connector 144 to rotate the auger 136.

With continued reference to FIG. 5, vibration isolators 148 are positioned within the barrel 124. The vibration isolators 148 are positioned between the gearbox 104 (including the exciter 208) and the barrel 124. The vibration isolators 148 may be rubber or another elastomeric material. The vibration isolators 148 have strong mechanical damping properties. As such, downward force generated by the gearbox 104 can be transmitted through the connector 112 and to the hammers 120 in a downward direction extending beyond the second end 100*b*. The vibration isolators 148 may inhibit upward force generated by the gearbox 104 from damaging other components of the drilling rig 10 (e.g., the hoses 34, the power unit 14, the Kelly bar 38, etc.). In the illustrated embodiment, the vibration isolators 148 are positioned to inhibit transmission of vibration between the gearbox 104 and the barrel 124 in a shearing direction parallel with the longitudinal axis 42 but offset from the gearbox 104. For example, if vibration generated by the gearbox 104 causes an upward force, the shear force absorbed by the vibration isolators 148 at least partially counteracts the upward force with an opposing downward force (as viewed in FIG. 5) at a position adjacent a sidewall of the barrel 124. The vibration isolators 148 extend between the gearbox 104 and the barrel 124 in a radial direction extending towards and away from the longitudinal axis 42. As such, the absorbing force of the vibration isolators 148 is a shearing force.

Figure 10A:
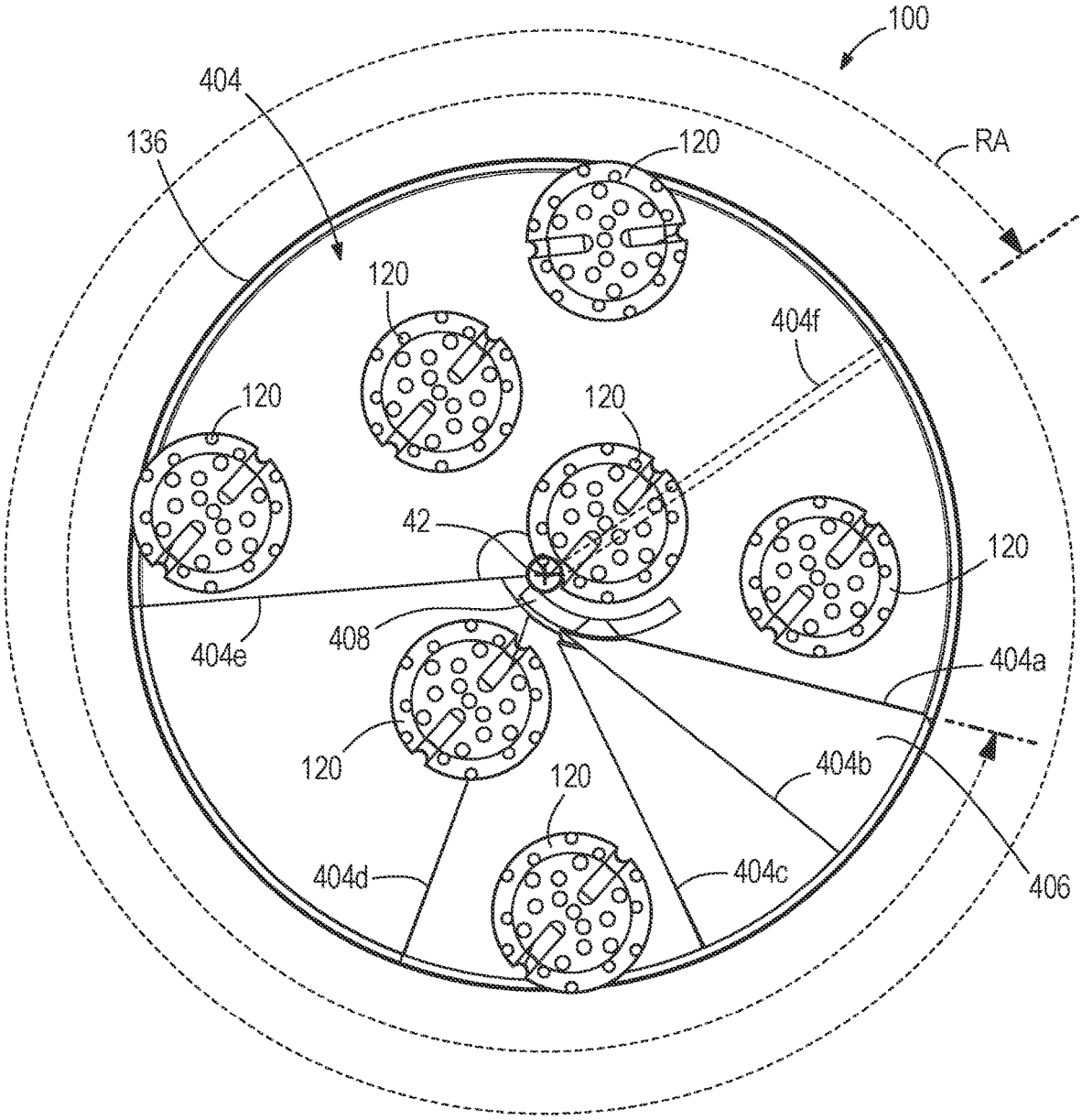
FIG. 10A is a bottom view of the hole opener of FIG. 1.
Figure 10B:
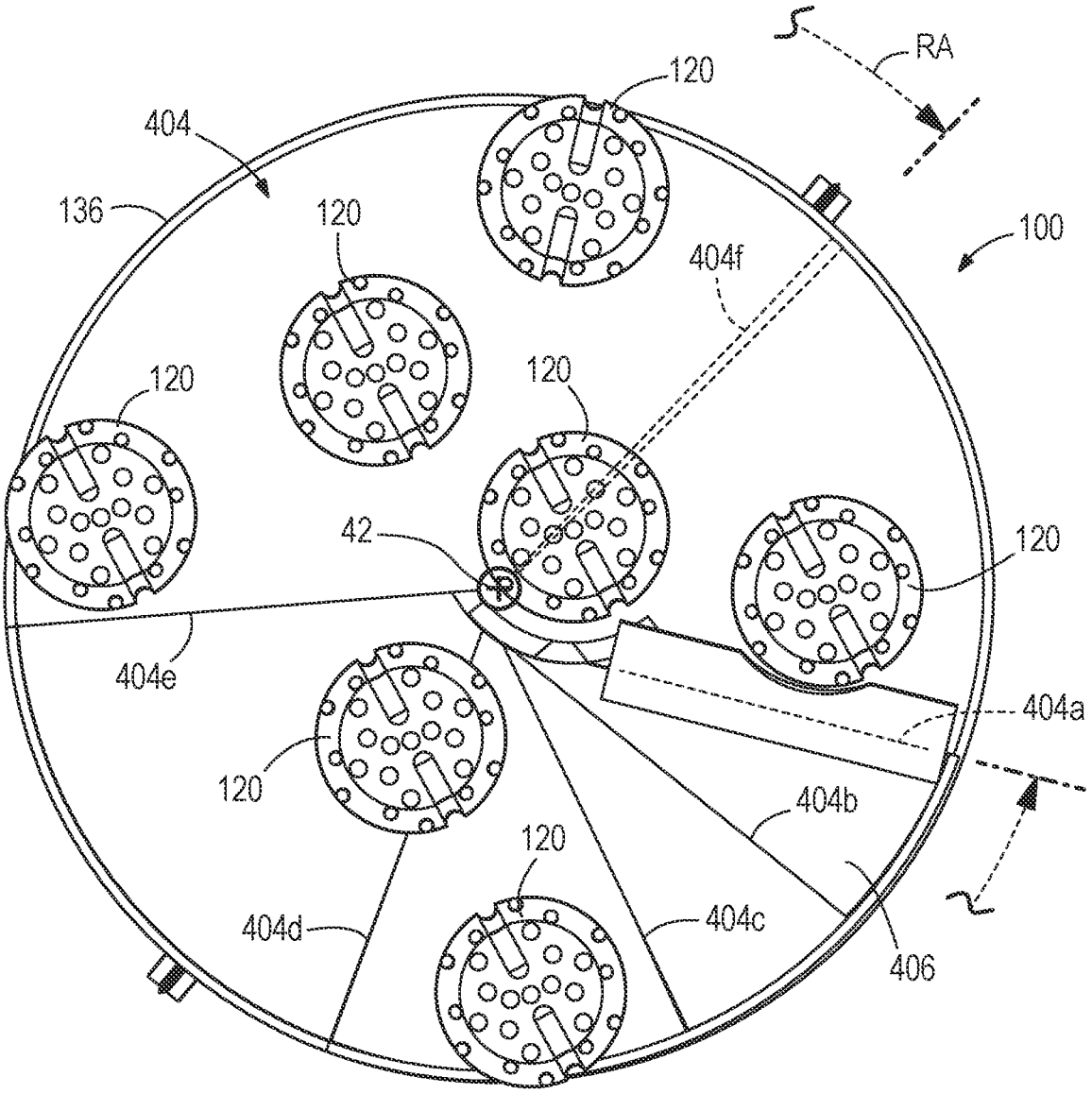
FIG. 10B is a bottom view of another hole opener.
Figure 11:
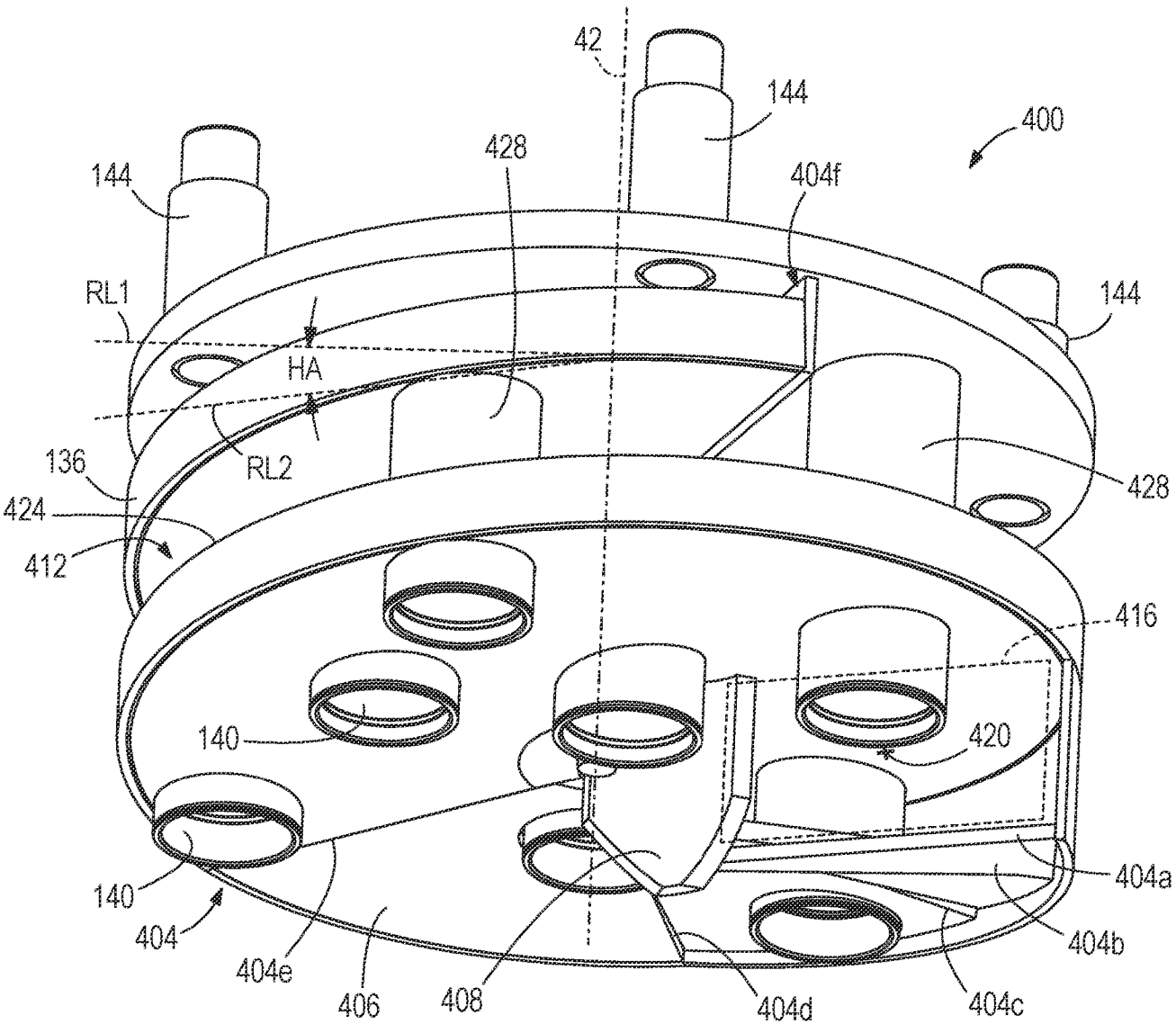
FIG. 11 is a perspective view of an auger of the hole opener of FIG. 1.

With reference to FIGS. 10 and 11, the auger 136 includes a top end 400 (FIG. 11) and an opposite bottom end 404 (FIGS. 10 and 11). The auger 136 includes a bottom plate 406 which is generally helically shaped around the axis 42. As shown in FIG. 11, the bottom plate 406 extends along a helix angle HA between a first reference line RL1 and a second reference line RL2. The first reference line RL1 is generally perpendicular to the axis 42. The second reference line RL2 follows the surface of the bottom plate 406. The helix angle HA may be between 1 and 10 degrees. In the illustrated embodiment, the helix angle HA is between 3 and 6 degrees (e.g., about 4.2 degrees). The bottom plate 406 is visible from the bottom end 404 (FIG. 10). The auger 136 may further include a spoon 408 which extends beyond the bottom plate 406 in a direction parallel to the axis 42. The bottom plate 406 is truncated by a plurality of steps 404*a*, 404*b*, 404*c*, 404*d*, 404*e*, 404*f*. The steps 404*a*, 404*b*, 404*c* may be at least partially protruded beyond the remainder of the generally helical bottom plate 406 such that the steps 404*a*, 404*b*, 404*c*, 404*d*, 404*e* may direct the cuttings generated by the hammers 120 into the auger 136. The step 404*a*, as best shown in FIG. 11 denotes the radial position of a first helical end of the bottom plate 406 adjacent the bottom end 404 of the auger 136. The step 404*f*, as best shown in FIG. 11, denotes the radial position of a helical end of the bottom plate 406 adjacent the top end 400 of the auger 136.

With continued reference to FIGS. 10 and 11, the step 404*f* is revolved about the axis 42 a revolve angle RA (FIG. 10) from the step 404*a*. The revolve angle RA of the auger 136 is at least 360 degrees. In other words, the step 404*f* (which denotes the radial position of a second helical end of the bottom plate 406) is revolved helically about the axis 42 from the step 404*a* (which denotes the radial position of a first helical end of the bottom plate 406) at least one full revolution (e.g., at least 360 degrees). In the illustrated embodiment, the revolve angle RA is between 360 and 540 degrees. In other words, the step 404*f* (which denotes the radial position of a second helical end of the bottom plate 406) is revolved helically about the axis 42 from the step 404*a* (which denotes the radial position of a first helical end of the bottom plate 406) between one full revolution (e.g., 360 degrees) and two full revolutions (e.g., 720 degrees). In some embodiments, an optimal revolve angle RA is between 600 and 700 degrees. In other embodiments, the revolve angle RA may be greater than two full revolutions (e.g., 720 degrees).

In the illustrated embodiment of FIG. 10A, the longitudinal axis 42 passes through one of the hammers 120. While the hammer 120 is not entirely centered about the longitudinal axis 42, the hammer 120 is configured to generate cuttings at a radial position corresponding to the longitudinal axis 42 (e.g., at the center of the hole opener). In some other embodiments, the hammer 120 may be entirely centered about the longitudinal axis 42. In other embodiments such as the hole opener 100 illustrated in FIG. 10B, the hammers 120 may each be offset from the longitudinal axis 42 such that the longitudinal axis 42 does not intersect any of the hammers 120.

The auger 136 includes a unique geometry which defines a generally helical void 412 revolved around the axis 42. The helical void 412 is bounded at least by the steps 404*a*, 404*f*. Generally speaking, the helical void 412 has a cross section 416 (FIG. 11) centered about a point 420. The point 420 is revolved about and along the axis 42 (i.e., between the bottom end 404 and the top end 400) to define the generally helical void 412. As illustrated in FIG. 11, the cross-section 416 of the illustrated auger 136 is generally rectangular, and is bounded by the bottom plate 406 and a sidewall 424. The sidewall 424 is also generally helically shaped along the axis 42, and is connected to the bottom plate 406. As mentioned above, the sleeves 140 pass through the auger 136. The auger 136 includes rods 428 which receive the sleeves 140. The rods 428 are hollow to receive the sleeves 140. The rods 428 take up some of the volume defined by the generally helical void 412. In operation of the hole opener 100, cuttings generated by the hammers 120 are collected by the auger 136 to be packed into the generally helical void 412 for storage. Cuttings are guided by the bottom plate 406 and the sidewalls 424 in a helical direction extending from the bottom end 404 towards the top end 400 as the Kelly bar 38 is rotated.

Figure 12:
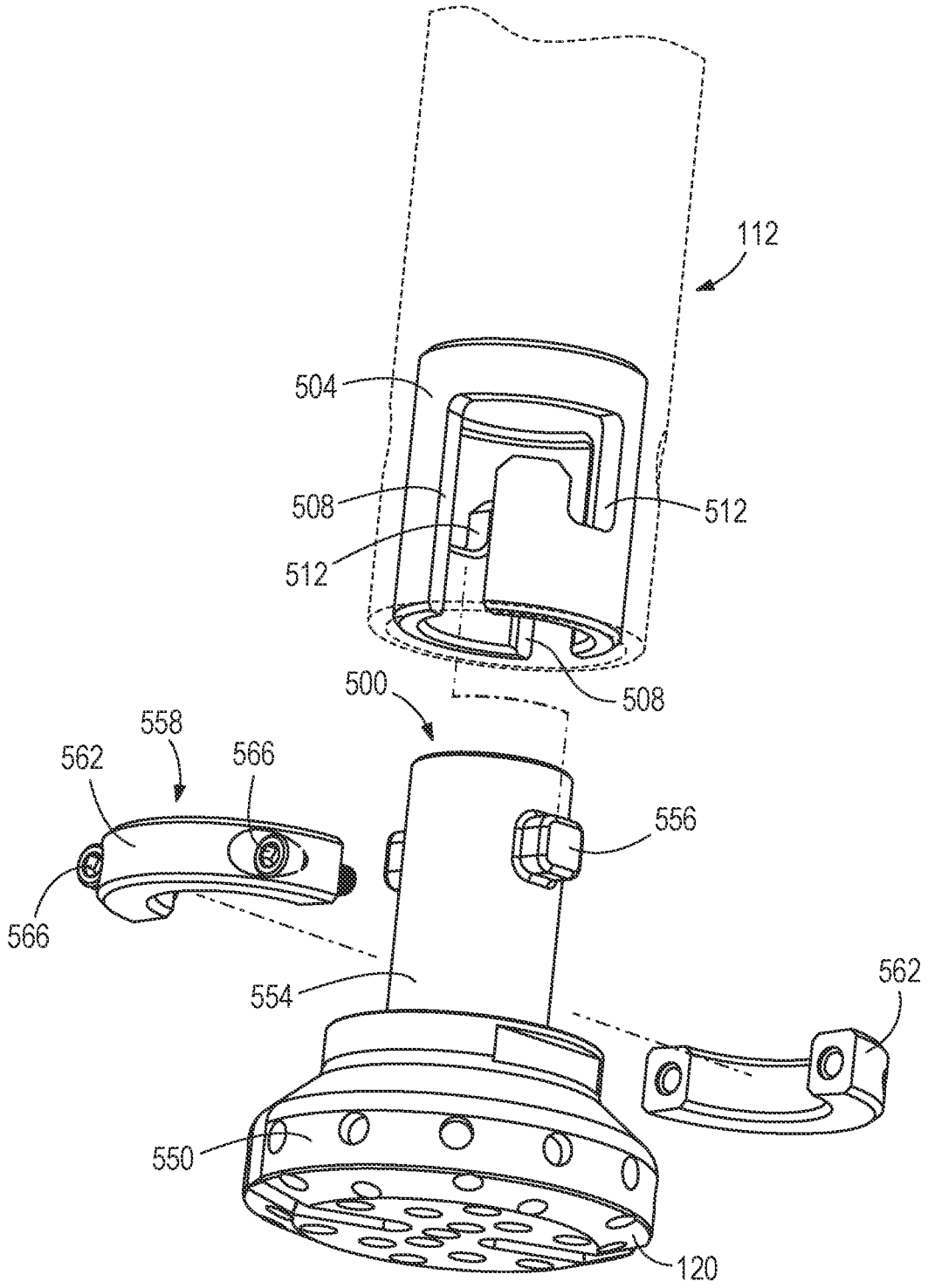
FIG. 12 is an exploded view of a hammer of the hole opener of FIG. 1.

With reference to FIGS. 5 and 12, an interface 500 between the hammer 102 and the connector 112 includes an annular ring 504 (FIG. 12). The annular ring 504 is seated (e.g., press-fit) within the connector 112 adjacent the second end 100*b* of the hole opener 100 (FIG. 5). In the illustrated embodiment, the annular ring 504 is a separate component with respect to the connector 112. However, in other embodiments, the connector 112 may be integrally formed with the annular ring 504. The annular ring 504 includes a void 508 therein (FIG. 12). The void 508 is in mechanical contact with an axial end of the annular ring 504 closest to the second end 100*b* of the hole opener 100. The void 508 further includes a hook portion 512 which extends from adjacent the first end 100*a* and towards the second end 100*b*. The hook portion 512 is spaced radially from the remainder of the void 508. As such, the void 508 and the hook portion 512 form a generally J-shaped hole in the annular ring 504. In the illustrated embodiment, the annular ring 504 includes multiple voids 508 and multiple hook portions 512. The voids 508 and hook portions 512 may be evenly circumferentially spaced about the annular ring 504.

With continued reference to FIG. 12, the hammer 120 includes a head 550 and a shank 554. The shank 554 is generally cylindrical in shape. The head 550 is generally frustoconical in shape, with a narrower radius portion thereof being attached to the shank 554. The shank 554 further includes protrusions 556 extending radially outwardly from the generally cylindrical shank 554. The protrusions 556 are located between axial ends of the shank 554. A clamp 558 surrounds the shank 554 at an axial position thereof adjacent the head 550. The clamp 558 includes thrust collars 562 and set screws 566. The trust collars 562 are generally annularly shaped, with each trust collar 562 surrounding a half of the shank 554. The thrust collars 562 permit the set screws 566 to provide a fitting between each thrust collar 562 and the shank 554 adjacent the head 550. The clamp 558 may inhibit rotation of the hammer 120 within the annular ring 504.

Prior to operation of the hole opener 100, the interface 500 between the hammer 120 and the connector 112 is assembled. The interface 500 slidably couples the hammer 120 to the connector 112 within the void 116. In the assembly, the protrusions 556 are radially aligned with the void 508. Subsequently, the hammer 120 is translated axially in a direction parallel to the axis 42 to the end of the void 508. The hammer 120 is then rotated in a direction parallel to the axis 42 such that the protrusions 556 are seated within the hook portion 512. In other words, the hammer 120 is positioned within the void 508 with the protrusion 556 located in the hook portion 512 such that the protrusion 556 limits axial travel (i.e., parallel to the axis 42) of the hammer 120 along the bounds of the hook portion 512. The thrust collars 562 can then be provided to surround the shank 554 adjacent the head 550, and the set screws 566 may be tightened. The thrust collars 562 have an outer diameter larger than an outer diameter than the shank 554, and generally corresponding with the outer diameter of the connector 112. As such, the thrust collars 562 may inhibit damage caused by impacts between the connector 112 and the head 550. During use of the hole opener 100, the hammer 120 is vibrated by the gearbox 104, and the hammer 120 freely translates axially (in a direction parallel to the axis 42) within the hook portion 512 due to the vibrations. In response to vibrations of the gearbox 104, the hammer 120 translates freely within the void 116 of the connector 112 between the first end 116*a* and the second end 116*b* thereof (FIG. 5). Other types of interfaces 500 between the hammer 120 and the connector 112 are possible.

Figure 14:
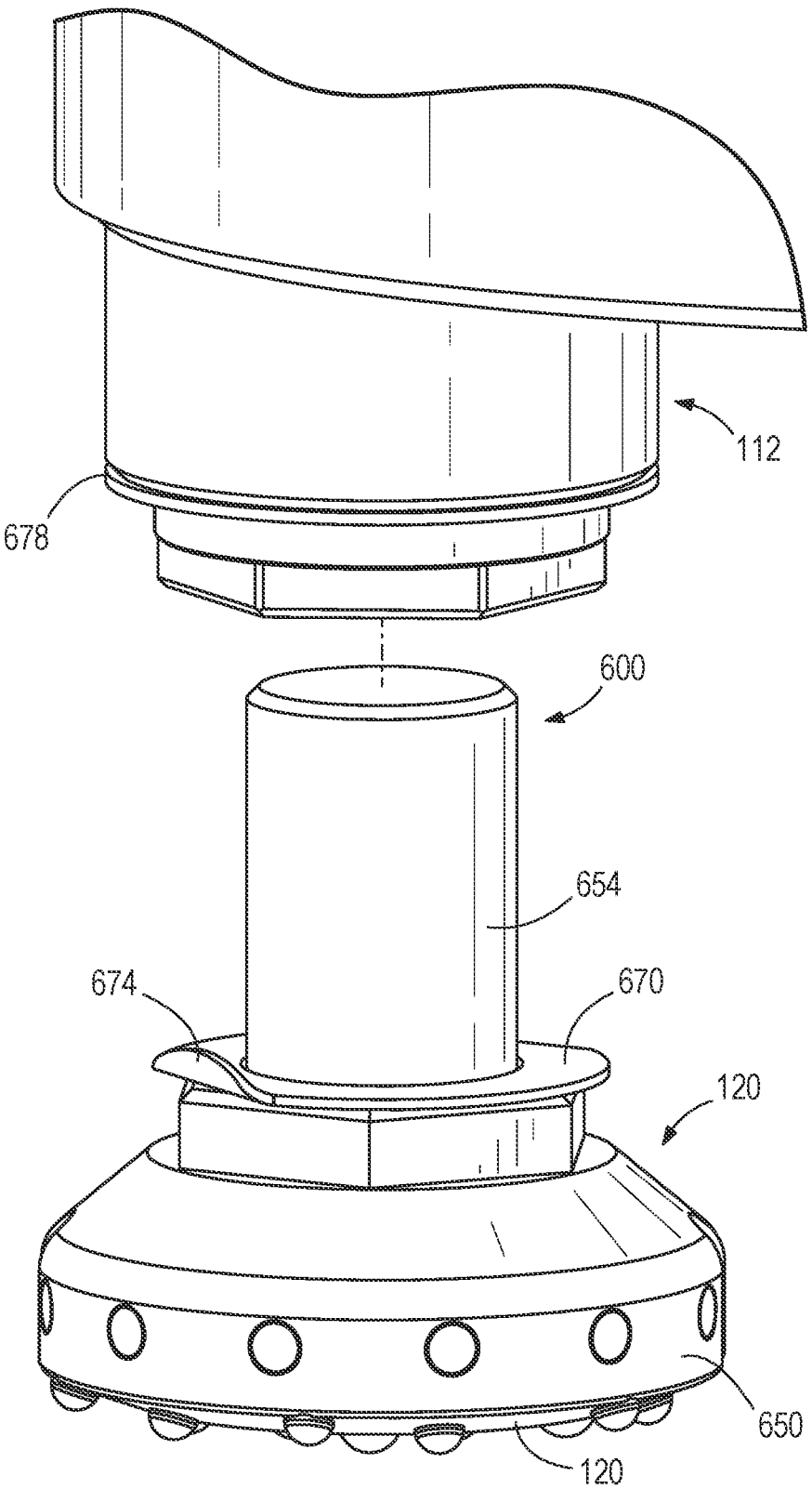
FIG. 14 is an exploded view of a hammer of another hole opener.

FIG. 14 provides an alternate interface 600 between the hammer 120 and the connector 112. The hammer 120 includes a head 650 and a shank 654 similar to the hammer 120 of the interface 500. The interface 600 further includes a lock washer 670 with a lip 674. The connector 112 includes an annular recess 678 on an outer surface thereof. The lock washer 670 surrounds the shank 654, and the lip 674 is configured to engage the annular recess 678. The lock washer 670 permits free translation of the hammer 120 within translational bounds afforded by the lock washer 670.

Figure 15:
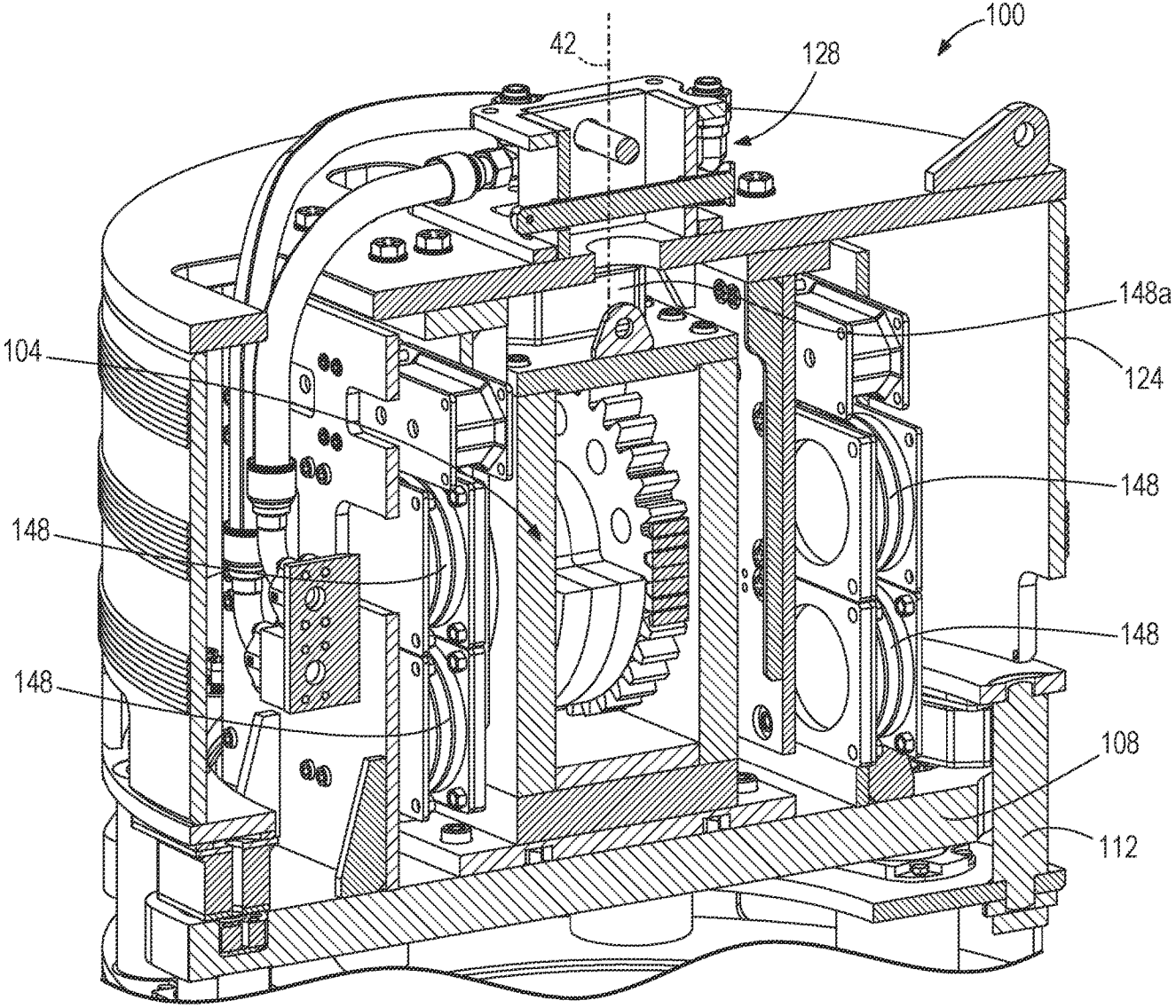
FIG. 15 is a cross-sectional view taken through a gearbox of another hole opener.

FIG. 15 provides an alternate arrangement of vibration isolators 148. In the embodiment illustrated in FIG. 15, a combination of shearing vibration isolators 148 and a compression vibration isolator 148*a* are provided. The shearing vibration isolators 148 are positioned similarly to the vibration isolators 148 as described above with regard to FIG. 5. The compression vibration isolator 148*a* is positioned axially between the gearbox 104 and the barrel 124 in a direction parallel to (e.g., coincident with) the longitudinal axis 42. The compression vibration isolator 148*a* is positioned in a longitudinal direction between the gearbox 104 and an end wall of the barrel which supports the Kelly-Jeffrey box 128. As such, the compression vibration isolator 148*a* is configured to compress to inhibit transmission of vibration between the gearbox 104 and the barrel 124 in a compressing direction parallel with the longitudinal axis 42. Any number of compression vibration isolators 148*a* may be provided. By providing both the shearing vibration isolators 148 and at least one compression vibration isolator 148*a*, higher amounts of vibration may be absorbed, and the hole opener 100 may operate at higher capacities.

Figure 16:
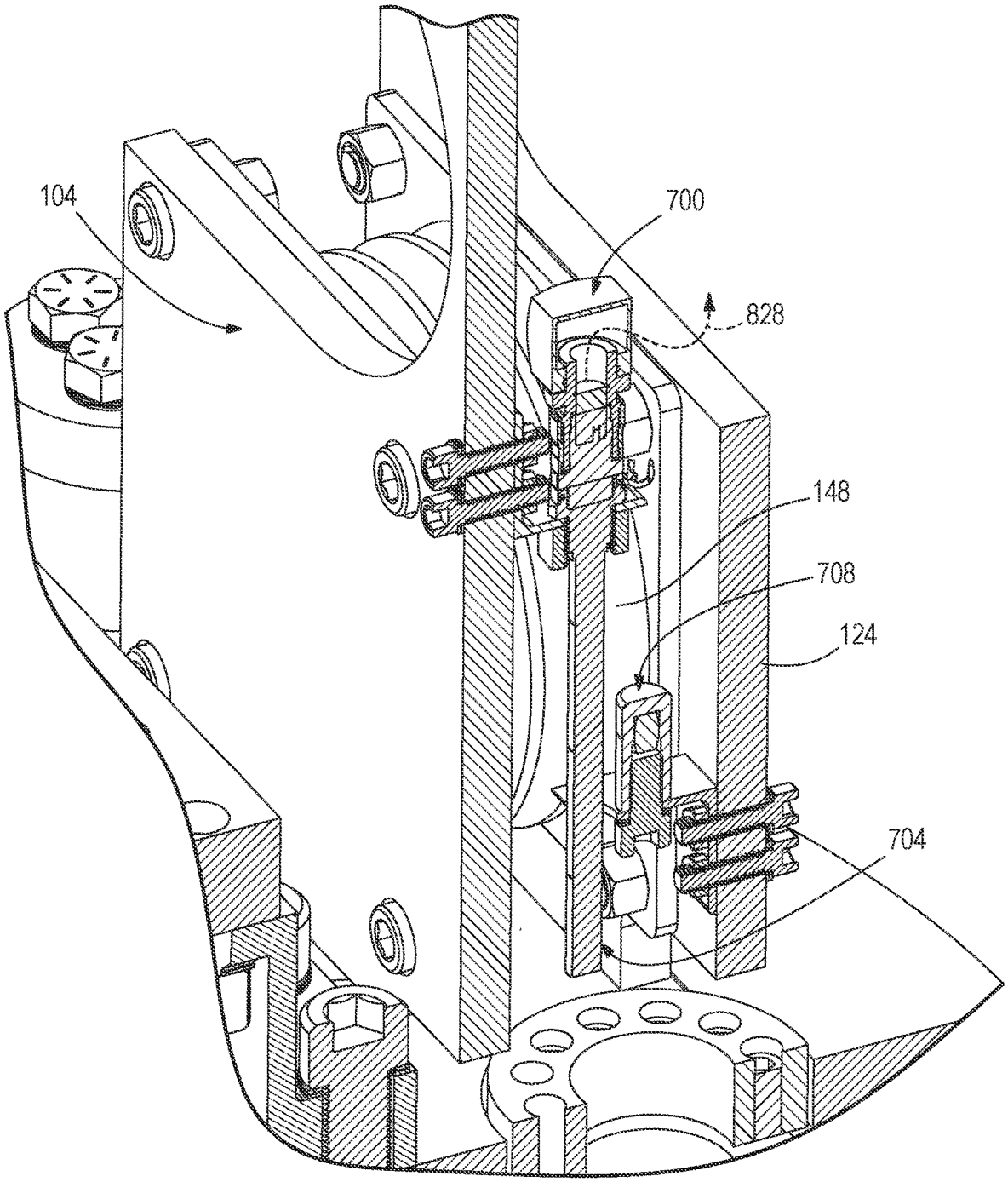
FIG. 16 is a cross-sectional view taken through a position sensor of another hole opener.

FIG. 16 illustrates an optional position sensor 700 for use with the hole opener 100. The position sensor 700 is configured to measure the position of the barrel 124 relative to the gearbox 104. The position sensor 700 is in electrical communication with the power unit 14 and is configured to provide live feedback to the operator of the drilling rig 10. The position sensor 700, the power unit 14, or a controller of the position sensor 700 power unit 14 may calculate a load applied on the hole opener at any moment of time during operation of the drilling rig 10. While any type of position sensor 700 may be used, the illustrated position sensor 700 may be a Hall-effect type position sensor including a Hall sensor 704 coupled with the gearbox 104 and a magnet 708 coupled with the barrel 124. In other embodiments, mounting of the Hall sensor 704 and magnet 708 may be reversed.

Figure 17:
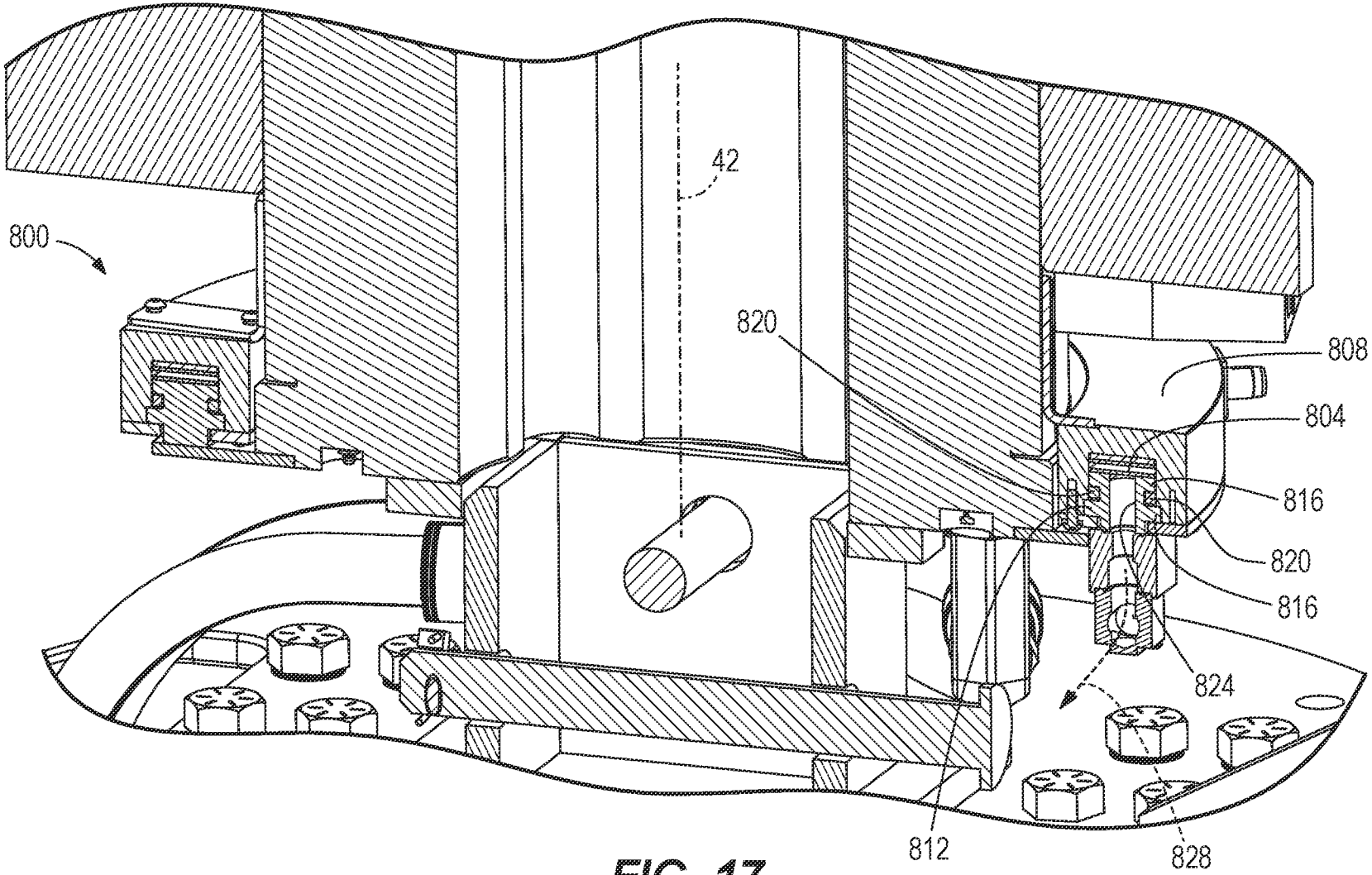
FIG. 17 is a cross-sectional view taken through a slip ring connector.

FIG. 17 illustrates an electric slip ring 800 configured for use with hole openers 100 having the above-described position sensor 700. The electric slip ring 800 is configured to electrically couple the position sensor 700 with power unit 14 and/or a controller of the power unit 14. The electric slip ring 800 includes an electrically conductive trace 804 which is annular in shape and circumscribes the longitudinal axis 42. The trace 804 is positioned within a u-shaped annular housing 808. The housing 808 also partially receives an annular spacer 812 therein. The spacer 812 includes a pair of tongues 816 extending radially outwardly from an outer surface of the spacer 812. The tongues 816 are axially spaced from one another. A pair of O-rings 820 are positioned between the tongues 816, the spacer 812, and the housing 808. The spacer 812 includes a through hole 824 configured to receive a signal wire 828 of the position sensor 700. The signal wire 828 is further illustrated in FIG. 16. The spacer 812 is permitted to rotationally slip about the longitudinal axis 42 during use of the hole opener 100 to permit rotational movement of the hole opener 100 relative to the Kelley bar 38 with the signal wire 828 remaining in electrical communication with the trace 804. The spacer 812 and the O-rings 820 inhibit ingress of water into the housing 808, and separate water and other fluids from the surroundings of the hole opener 100 from contacting the trace 804. The trace 804 is electrically coupled to the power unit 14.

Figure 18:
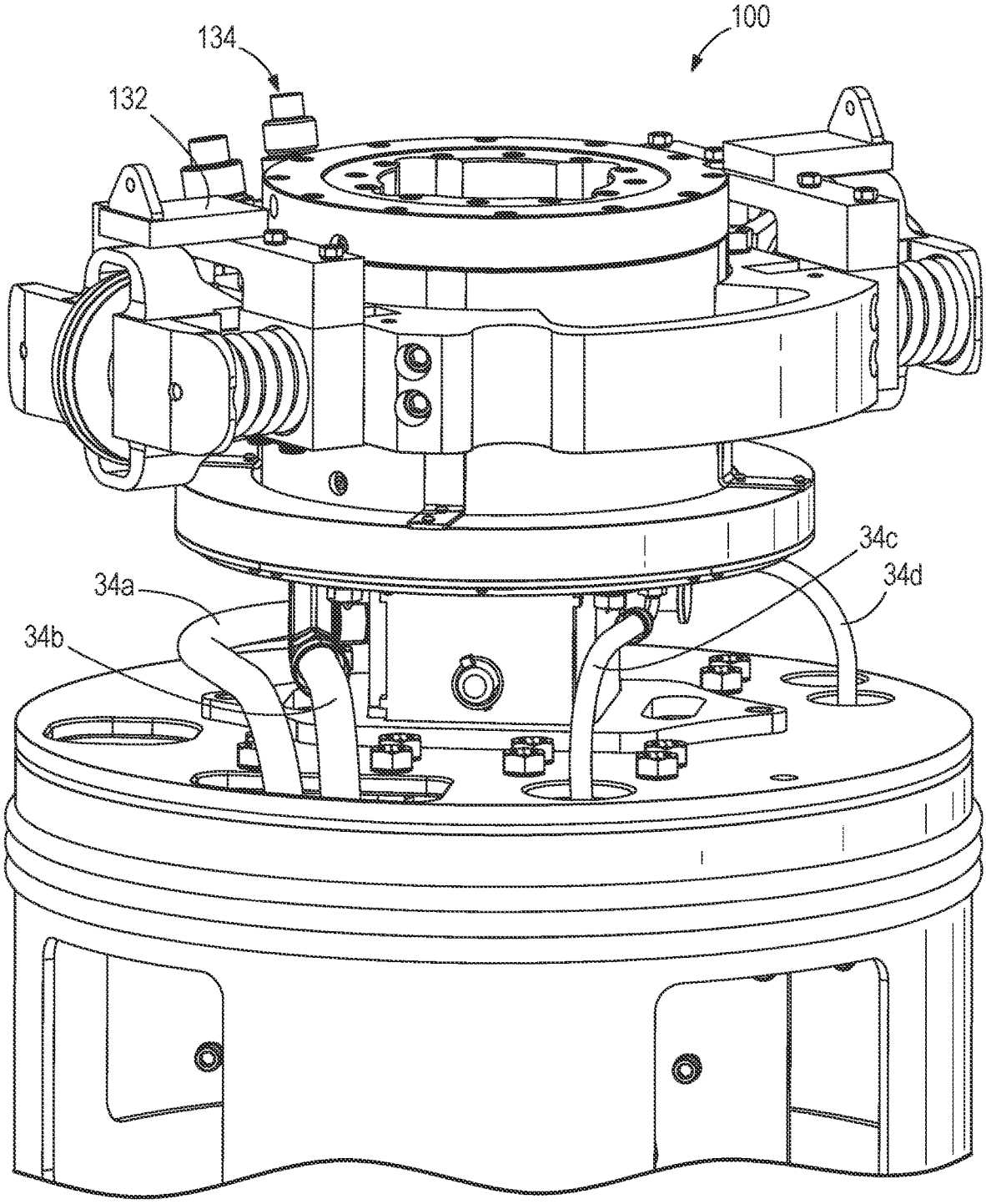
FIG. 18 is a perspective view of another hole opener including a gear box breathing air hose.

FIG. 18 illustrates an alternate hydraulic hose arrangement including a fourth hydraulic hose 34*d* which is in fluid communication with the interior of the gear box 104 and the drilling rig 10. The hose 34*d* is configured to supply breathing air from the drilling rig 10 to the interior of the gear box 104. The breathing air within the gear box 104 may be at a higher pressure than water surrounding the hole opener 100 during underwater drilling conditions.

Figure 19:
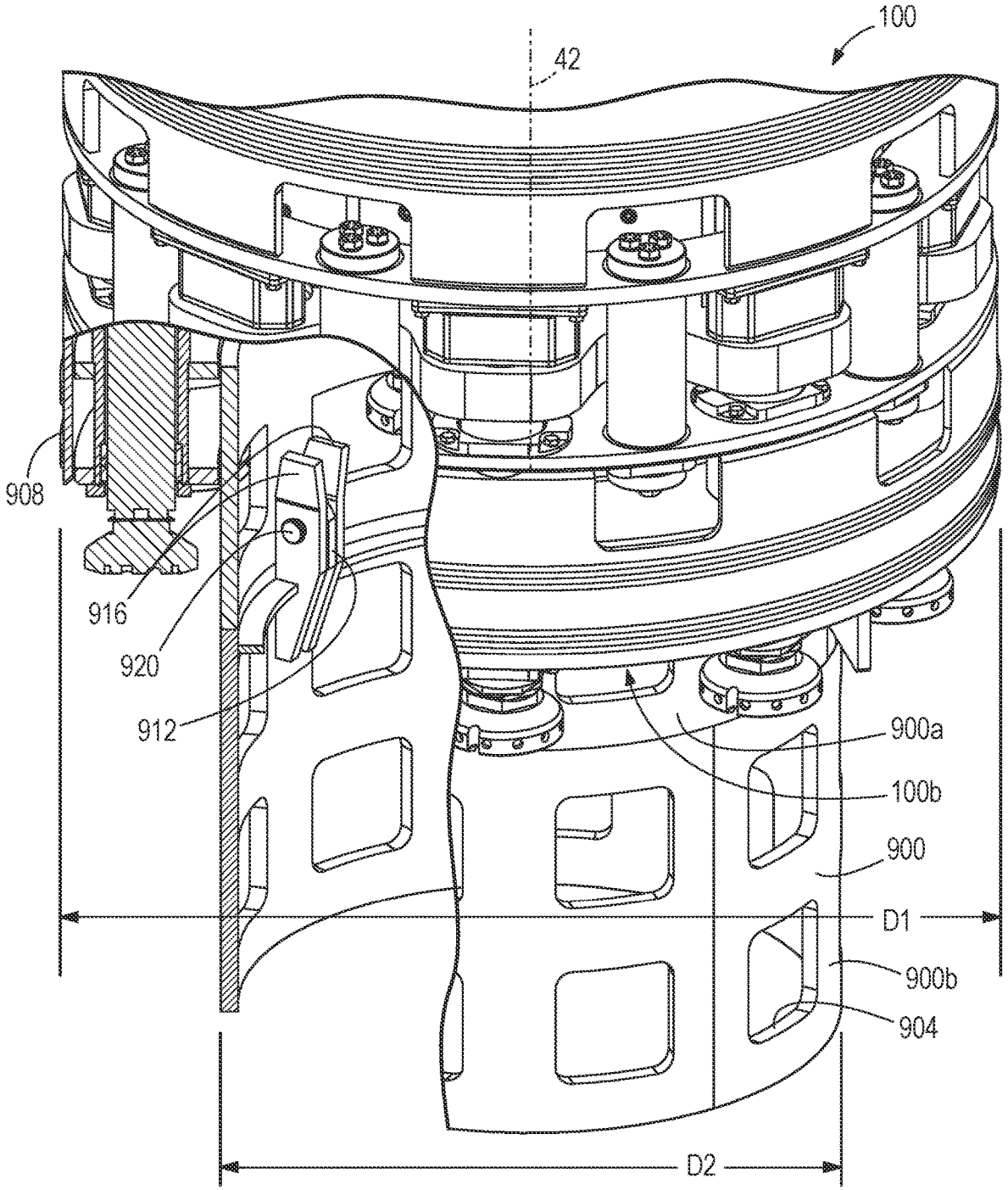
FIG. 19 is a perspective view of another hole opener including an extension ring.

FIG. 19 illustrates a hole opener 100 including an extension ring 900. The extension ring 900 is coupled to the hole opener 100 at the second end 100*b* thereof. In the illustrated embodiment, the hole opener 100 has an outer diameter D1 which is smaller than an outer diameter D2 of the extension ring 900. The illustrated extension ring 900 includes an array of cutouts 904. The extension ring 900 includes a proximal portion 900*a* and a distal portion 900*b*. The proximal portion 900*a* may be integrally formed with an auger 908 of the hole opener 100. Alternatively, the proximal portion 900*a* may be removable from the auger 908. The distal portion 900*b* is removably coupled to the proximal portion 900*a* by an interface including a locating protrusion 912 of the distal portion 900*b*, pair of stations 916 provided by the proximal portion 900*a*, and a removable pin 920 configured to secure the locating protrusion 912 to the pair of stations 916. The extension ring 900 may be removably coupled to the second end 100*b* of the hole opener 100. The extension ring 900 may provide added stability when drilling on irregular soil. The irregular soil may pass through the cutouts 904.

Various features of the invention are set forth in the following claims.

What is claimed is:

1. A hole opener configured for use with a power unit to open a hole, the hole opener comprising:

a gearbox including a hydraulic inlet fluidly coupled to the power unit, and an exciter fluidly coupled to the hydraulic inlet, the exciter being coupled to a gear train which is configured to generate vibrations upon receipt of pressurized hydraulic fluid from the hydraulic inlet, a plurality of connectors coupled to the gearbox for receiving the vibrations, each of the plurality of connectors defining a void, and a plurality of hammers slidably coupled to a corresponding one of the plurality of connectors within the void, the plurality of hammers configured to receive the vibrations from the corresponding one of the plurality of connectors and to transmit the vibrations to the hole.

2. The hole opener of claim 1, wherein the gearbox is mounted on a mount plate, and each of the plurality of connectors are coupled to the mount plate.

3. The hole opener of claim 2, further comprising a plurality of tensioners which each connect one of the plurality of connectors to the mount plate.

4. The hole opener of claim 2, wherein the mount plate is generally planar in a direction perpendicular to a longitudinal axis of the hole opener.

5. The hole opener of claim 1, wherein the hole opener is oriented along a longitudinal axis, and at least one of the plurality of hammers is offset from the longitudinal axis.

6. The hole opener of claim 1, wherein the exciter includes an output shaft coupled to the gear train, the output shaft being rotatable by a difference in pressure between hydraulic fluid on opposite ends of the exciter.

7. The hole opener of claim 1, wherein the gearbox further includes a hydraulic outlet fluidly coupled to the power unit and configured to return de-pressurized fluid from the exciter to the power unit.

8. The hole opener of claim 7, further comprising a motor return line coupled to the exciter.

9. The hole opener of claim 1, further comprising a hose configured to supply breathing air to the interior of the gearbox.

10. The hole opener of claim 1, wherein the gear train includes two counter rotating masses, the two counter rotating masses being configured to each contribute to the generation of vibrations upon receipt of pressurized fluid.

11. The hole opener of claim 1, wherein at least one of the plurality of connectors includes an annular ring having a void with a hook portion, and at least one of the plurality of hammers includes a protrusion extending radially outwardly from the hammer, wherein the at least one of the plurality of hammers is positioned within the void with the protrusion located in the hook portion such that the protrusion limits axial travel of the hammer along the bounds of the hook portion.

12. The hole opener of claim 11, further comprising a clamp surrounding at least one of the plurality of hammers to inhibit rotation of the hammer within the annular ring.

13. A hole opener configured for use with a power unit and a Kelly bar to open a hole, the hole opener comprising:

a gearbox including a hydraulic inlet fluidly coupled to the power unit, and an exciter fluidly coupled to the hydraulic inlet, the exciter being coupled to a gear train including an imbalanced mass which is configured to generate vibrations upon receipt of pressurized hydraulic fluid from the hydraulic inlet, a connector coupled to the gearbox for receiving the vibrations, the connector defining a void, a hammer slidably coupled to the connector within the void, the hammer configured to receive the vibrations from the connector and to transmit the vibrations to the hole, a barrel at least partially surrounding the gearbox, the barrel including a Kelly-Jeffrey box configured to receive external force from the Kelly bar, and a swivel coupled to the Kelly-Jeffrey box and operable to rotate about the Kelly-Jeffrey box, the swivel further including a coupling in fluid communication with the hydraulic inlet and the power unit such that hydraulic fluid passes through the coupling to power the exciter.

14. The hole opener of claim 13, further comprising vibration isolators positioned between the gearbox and the barrel to inhibit the vibrations generated by the gearbox from damaging at least one of the power unit or the Kelly bar.

15. The hole opener of claim 14, wherein at least one of the vibration isolators is configured to be compressed.

16. The hole opener of claim 13, wherein the external force is a downward force, and the Kelly-Jeffrey box transmits the downward force to the barrel.

17. The hole opener of claim 13, wherein the external force is a rotary force, and the Kelly-Jeffrey box transmits the rotary force to the barrel.

18. The hole opener of claim 13, further comprising a position sensor configured to measure the position of the barrel relative to the gearbox.

19. The hole opener of claim 18, further comprising an electric slip ring configured to electrically couple the position sensor with a controller for determining a load applied to the hole opener, the electric slip ring including an electrical trace in electrical communication with the position sensor during operation of the hole opener.

20. A hole opener configured for use with a power unit to open a hole, the hole opener comprising:

a gearbox including a hydraulic inlet fluidly coupled to the power unit, and an exciter fluidly coupled to the hydraulic inlet and configured to generate vibrations upon receipt of pressurized hydraulic fluid from the hydraulic inlet; and a connector coupled to the gearbox for receiving the vibrations, the connector defining a void, a hammer slidably coupled to the connector within the void, the hammer configured to receive the vibrations from the connector and to transmit the vibrations to the hole to generate cuttings, and an auger configured to collect the cuttings, the auger defining a generally helical void revolved along and about an axis between helical ends a revolve angle extending greater than 360 degrees.

21. The hole opener of claim 20, wherein the hole opener further comprises a barrel at least partially surrounding the gearbox, the auger being coupled to the barrel by a torsion connector.

22. The hole opener of claim 21, wherein the hole opener is configured for use with a Kelly bar to open the hole and the barrel includes a Kelly-Jeffrey box configured to receive external force from the Kelly bar, wherein the torsion connector transmits torque from the Kelly bar from the barrel to the auger.

23. The hole opener of claim 20, wherein the auger includes a bottom plate and a sidewall which are each revolved along and about the axis to define the generally helical void.

24. The hole opener of claim 23, wherein the bottom plate of the auger is extended along a helix angle measured from perpendicular to the axis of between 3 and 10 degrees.

25. The hole opener of claim 20, wherein the generally helical void has a rectangular cross-section.

26. The hole opener of claim 20, wherein the auger includes a rod which receives sleeve, the sleeve supporting the connector therein, and wherein the rod takes up a portion of the generally helical void.

27. The hole opener of claim 20, further comprising an extension ring removably coupled to the auger.

* * * * *